US008303736B2

(12) United States Patent
Matsuoka

(10) Patent No.: US 8,303,736 B2
(45) Date of Patent: Nov. 6, 2012

(54) CASTED ALUMINUM ALLOY AND METHOD FOR PRODUCING THE SAME AS WELL AS ALUMINUM ALLOY MATERIAL AND METHOD FOR PRODUCING THE SAME

(75) Inventor: Hideaki Matsuoka, Aichi-gun (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 0 days.

(21) Appl. No.: 12/524,004

(22) PCT Filed: Jan. 22, 2008

(86) PCT No.: PCT/JP2008/050766

§ 371 (c)(1),
(2), (4) Date: Jul. 22, 2009

(87) PCT Pub. No.: WO2008/090866

PCT Pub. Date: Jul. 31, 2008

(65) Prior Publication Data

US 2010/0098580 A1 Apr. 22, 2010

(30) Foreign Application Priority Data

Jan. 22, 2007 (JP) ..... 2007-011756

(51) Int. Cl.
*C22C 21/00* (2006.01)

(52) U.S. Cl. ..... 148/415; 148/417; 420/551

(58) Field of Classification Search ..... 148/415, 148/417; 420/551

See application file for complete search history.

(56) References Cited

FOREIGN PATENT DOCUMENTS

| | | | |
|---|---|---|---|
| EP | 0 564 815 | A2 | 10/1993 |
| EP | 0 564 815 | A3 | 10/1993 |
| EP | 0 693 567 | A2 | 1/1996 |
| EP | 0 693 567 | A3 | 1/1996 |
| GB | 1 475 587 | | 6/1977 |
| JP | 5 9634 | | 1/1993 |
| JP | 05009634 | A * | 1/1993 |
| JP | 8 165538 | | 6/1996 |
| JP | 2004 156117 | | 6/2004 |
| JP | 2006 249550 | | 9/2006 |

* cited by examiner

*Primary Examiner* — George Wyszomierski
*Assistant Examiner* — Janelle Morillo
(74) *Attorney, Agent, or Firm* — Oblon, Spivak, McClelland, Maier & Neustadt, L.L.P.

(57) ABSTRACT

A casted aluminum alloy obtained by casting a molten metal of an aluminum alloy, an aluminum alloy material obtained by at least heating the casted aluminum alloy, and methods for producing them. In the production of the casted aluminum alloy, a molten metal is obtained by melting an aluminum alloy containing 0.8 to 5 mass % of Fe, 0.15 to 1 mass % of Ti, Zr or the like as third component elements in an specific amount, and a residual part containing Al and inevitable impurities at a certain temperature (melting step). Subsequently, the molten metal is cast into a plate-like shape by a casting mold while cooling the molten metal to a temperature that is lower by at least 10° C. than a solidus temperature of the aluminum alloy at a cooling rate of 150° C./sec. or more and less than 10000° C./sec. (casting step).

23 Claims, 25 Drawing Sheets

CASTED ALUMINUM ALLOY AND METHOD FOR PRODUCING THE SAME AS WELL AS ALUMINUM ALLOY MATERIAL AND METHOD FOR PRODUCING THE SAME

TECHNICAL FIELD

The present invention relates to a casted aluminum alloy obtained by casting a molten metal alloy into a plate-like shape and a method for producing the casted aluminum alloy as well as to an aluminum alloy material obtained by processing and/or heating the casted aluminum alloy and a method for producing the aluminum alloy material.

BACKGROUND ART

A rolled aluminum alloy sheet has been produced by: semi-continuously casting of a molten alloy product adjusted to a predetermined composition into a rolling ingot; slab cutting; homogenization step; surface cutting step; heating; and hot rolling. Cold rolling is performed when so required after the hot rolling. In such a rolled aluminum alloy sheet production process, a predetermined shape is achieved while melting coagulated structures, and adjustment for obtaining a homogenous and fine structure is performed. Also, in the rolling step, quality control (e.g. heat treatment) that is varied depending on the alloy type has been performed. Since there are the various rolled aluminum alloy sheet production steps as described above, there has been a limit in reduction in energy consumption and reduction in cost.

In recent years, a continuous casting method for aluminum alloy has been studied. This method is a method for continuously and directly casting a sheet material having a predetermined thickness from a molten metal of an aluminum alloy. In the continuous casting method, it is possible to continuously cast a sheet material having a thickness of 10 mm or less, for example, which is thinner than a slab. Therefore, a cooling rate is higher than that of the conventional ingot continuous casting, thereby obtaining a finer cast structure. Also, due to the high cooling rate, an allowable amount of Fe which has ordinarily been treated as an impurity element is increased, and recyclability of aluminum alloy is improved. Further, since it is possible to largely reduce the number of production steps, cost reduction can be achieved.

A 5000-system (Al—Mg) aluminum alloy has been mainly used as the rolled aluminum alloy sheet for an automobile outer panel, for example. As other examples, use of an excessive Si type 6016 alloy or 6022 alloy (Al—Mg—Si alloy) having a bake-hardening property has been studied in recent years. As used herein, "bake-hardening" means an aging phenomena utilizing heat in a baking step for an automobile.

For instance, in the Al—Mg—Si alloy, a material on which only a solution treatment has been performed (refinement: T4) is press-molded into a predetermined shape, and hardening is performed in a subsequent baking step, thereby obtaining the rolled aluminum alloy sheet for outer panels. Among aluminum alloys, the 6000-system alloy, such as the Al—Mg—Si alloy has strength and good corrosion resistance and has been used as an underbody material of an automobile or the like. In the 6000-system alloy, since such excellent properties are integrated with the above-described bake-hardening property and continuous casting and rolling, energy consumption for production is further reduced, thereby obtaining a highly functional and low cost material (see Patent Documents 1 to 3).

The level of strength of an aluminum alloy depends much on an alloy composition. Particularly, examples of an aluminum alloy capable of expressing high strength include a heat treated alloy which is precipitation strengthened by an aging treatment, and representative examples thereof include a 7000-system alloy (Al—Zn—Mg alloy) and a 2000-system alloy (Al—Cu alloy). The 6000-system alloy also belongs to this type but is inferior in strength properties as compared with other heat treated alloys. Meanwhile, a high strength 6000-system alloy to which Cu is added is under development.

However, like the 2000-system alloy and the 7000-system alloy, the Cu-added 6000-system alloy has a problem of reductions in processability and corrosion resistance despite the improvement in strength. Therefore, it has been difficult from the practical point of view to adapt the rolled aluminum alloy sheet made from such aluminum alloy to the outer plate, underbody, or the like of automobile to which corrosion resistance is required.

Also, the strength is improved by addition of an additive element in the rolled aluminum alloy sheet as described above, however, in an Al—Fe—Ni alloy or the like, for example, softening resistance is insufficient, and hardness (residual hardness) after casting, annealing, and long time heating, is subject to a large reduction as compared with the hardness after casting despite its heat resistance, i.e. its excellent strength at high temperatures. Therefore, it is impossible to perform high temperature aging on such aluminum alloy, and, consequently, since strength at room temperature is reduced after the high temperature heating despite the excellent strength under high temperature environments, it has been difficult to use such an aluminum alloy for parts to be used under high temperature environments.

As described above, as the rolled aluminum alloy sheets constituting automobile structural parts and the like, there has been a demand for the one that is capable of being molded into various desired shapes and excellent not only in strength, corrosion resistance, and the like, but also in softening resistance and the like.

It has been quite difficult to industrially produce a rolled aluminum alloy sheet that satisfies these property requirements using the aluminum alloy conventionally used.

Patent Document 1: JP 8-165538 Unexamined Patent Publication (Kokai)

Patent Document 2: JP 2004-156117 Unexamined Patent Publication (Kokai)

Patent Document 3: JP 2006-249550 Unexamined Patent Publication (Kokai)

DISCLOSURE OF THE INVENTION

Problems to be Solved by the Invention

The present invention was accomplished in view of the above-described conventional problems, and an object thereof is to provide a casted aluminum alloy and an aluminum alloy material that can be produced at a low cost and are excellent in strength, formability, corrosion resistance, and softening resistance as well as methods for producing them.

Means for Solving the Problems

A first invention is a method for producing a casted aluminum alloy obtained by casting a molten metal of an aluminum alloy, characterized by comprising:

a melting step of preparing an aluminum alloy comprising: 0.8 to 5 mass % of Fe as a first component element, 0.15 to 1 mass % of Ti as a second component element, one or more kinds of third component elements selected from a third component element group consisting of Zr, Nb, Hf, Sc, and Y at a content of 0.05 to 2 mass % of each of the third components and in an amount that satisfies Fe>X>Ti when the content of the first component element Fe is Fe (mass %), the content of the second component element Ti is Ti (mass %), and a total content of the third component elements is X (mass %); and a residual part comprising Al and inevitable impurities, and melting the aluminum alloy at a temperature that is higher by 20° C. or more than a liquidus temperature determined by the composition of the aluminum alloy to obtain a molten metal; and a casting step of casting the molten metal into a casting mold and then cooling the molten metal to a temperature that is lower by at least 10° C. than a solidus temperature determined by the composition of the aluminum alloy at a cooling rate of 150° C./sec. or more and less than 10000° C./sec.

The production method of the first invention includes the melting step and the casting step.

In the melting step and the casting step, the molten metal is produced by melting the aluminum alloy of the specific composition, and the casted aluminum alloy is produced by casting the molten metal while cooling the molten metal. Therefore, in the first invention, it is possible to directly cast the molten metal into a plate-like shape or the like, and it is possible to omit a step of producing a slab (ingot) and the like. Consequently, the number of steps can be reduced, and the casted aluminum alloy can be produced at a low cost.

In the method for producing of the present invention, the casting is performed by using the aluminum alloy having the specific composition having the first to third component elements contained in the specific amounts and the residual part comprising Al and inevitable impurities while cooling the molten metal of the aluminum alloy at the specific cooling rate. Therefore, the casted aluminum alloy that has excellent strength, formability, corrosion resistance, and softening resistance can be obtained even when the direst casting from the molten metal to the plate-like shape, for example, is performed.

The aluminum alloy within the specific composition range exhibits an excellent casting property without addition of Si. Therefore, the casting property is improved while avoiding deterioration in material properties caused by the Si addition. Also, the aluminum alloy exhibits excellent heat resistance without addition of Ni or Mn.

Further, in the method for producing of the present invention, the casting is performed while cooling the molten metal of the aluminum alloy of the specific composition at the specific cooling rate. Therefore, the casted aluminum alloy exhibits the excellent strength and the excellent softening resistance, and hardness thereof at a room temperature is hardly reduced after being exposed to a high temperature environment which is ½ or more of the solidus temperature determined by the composition of the aluminum alloy. Therefore, the casted aluminum alloy can undergo aging at a high temperature, such as 200° C. or more, and the strength thereof is improved further. Consequently, even when hot rolling, annealing, and the like are performed on the casted aluminum alloy in subsequent steps, the strength of the casted aluminum alloy is not reduced, or, rather, it is improved. Reasons for such strength are considered to be as follows.

In the case of adding Fe to an aluminum alloy as in the present invention, there are formed, as a metal structure, an α phase that is formed of an Al matrix and a layered phase that is formed of an eutectic structure of an Al—Fe compound and the Al matrix in such a manner as to surround the α phase. When the second component element Ti and the third component element are added by the specific amounts, it is possible to dissolve the second component element and the third component element into Al, thereby enabling formation of an Al matrix formed of an supersaturated solid solution. This makes it possible to precipitate a stable compound (intermetallic compound) phase formed of Al, Ti (the second component element), and the third component element in the Al matrix when heat energy or strain energy is applied. For this reason, the softening resistance is improved to enable the improvement in strength after the above-described processing and heating, and the like.

Also, in the present invention, it is possible to prevent a reduction in strength that can be caused when returned to a room temperature after a use under a high temperature environment for a long time, thereby making it possible to maintain the strength higher than the strength after the casting. Further, by adjusting the alloy composition and the cooling rate within the ranges of the present invention, the strength after the use under high temperature environment for a long time is not reduced but rather the strength can be further improved.

Consequently, in the first invention, it is possible to produce the casted aluminum alloy that is suitable for automobile structural parts and the like.

Also, in the method for producing of the present invention, the casting is performed at the high cooling rate of 150° C./sec. or more. Therefore, allowable amounts of impurity elements can be increased, thereby improving recyclability.

As described above, according to the first invention, it is possible to provide the method for producing the casted aluminum alloy that can be produced at low cost and that is excellent in strength, formability, corrosion resistance, and softening resistance.

A second invention is a method for producing an aluminum alloy material, characterized by comprising a hot rolling step of reducing a thickness of the casted aluminum alloy obtained by the production method of the first invention by 30% or more by performing hot rolling on the casted aluminum alloy at a temperature of 200° C. or more.

A third invention is a method for producing an aluminum alloy material, characterized by comprising a cold rolling-heating step of performing cold rolling on the casted aluminum alloy obtained by the production method of the first invention thereby to reduce a thickness of the casted aluminum alloy by 30% or more, and subsequently heating at a temperature of ½ or more of a melting point of the aluminum alloy and 550° C. or less.

A fourth invention is a method for producing an aluminum alloy material, characterized by comprising a heat treatment step of heating the casted aluminum alloy obtained by the production method of the first invention at a temperature of 400° C. or more for 0.5 to 3 hours.

In each of the second to fourth inventions, the hot rolling step, the cold rolling-heating step, or the heat treatment step is performed on the casted aluminum alloy obtained by the production method of the first invention. Therefore, it is possible to form a precipitate of an intermetallic compound formed of Al, the second component element, and the third component element in the aluminum alloy material to be obtained. The precipitate is considered to form a stable phase or metastable phase in the metal structure. The aluminum alloy material having such metal structure exhibits more excellent strength as compared with the casted aluminum alloy. Also, it is possible to produce other effects same as those of the first invention.

A fifth invention is a casted aluminum alloy characterized by comprising:

0.8 to 5 mass % of Fe as a first component element, 0.15 to 1 mass % of Ti as a second component element, one or more kinds of third component elements selected from a third component element group consisting of Zr, Nb, Hf, Sc, and Y at a content of 0.05 to 2 mass % of each of the third components and in an amount that satisfies Fe>X>Ti when the content of the first component element Fe is Fe (mass %), the content of the second component element Ti is Ti (mass %), and a total content of the third component elements is X (mass %); and a residual part comprising Al and inevitable impurities, wherein the casted aluminum alloy has a metal structure including an α phase that is formed of an Al matrix and a layered phase that is formed of an eutectic structure of the Al matrix and an Al—Fe compound in such a manner as to surround the α phase;

the Al matrix is formed of a supersaturated solid solution of Al in which the second component element and the third component element are dissolved; and an area ratio of a crystallizate formed of an intermetallic compound of Al, the second component element, and the third component element and having a particle diameter of 5 μm or more is less than 5% in an arbitrary section of the casted aluminum alloy.

The casted aluminum alloy has the specific composition and the metal structure including the α phase that is formed of an Al matrix and the layered phase that is formed of a eutectic structure of the Al matrix and an Al—Fe compound in such a manner as to surround the α phase. The Al matrix is formed of a supersaturated solid solution of Al in which the second component element and the third component element are dissolved, and an area ratio of a crystallizate formed of a compound of Al, the second component element, and the third component element and having a particle diameter of 5 μm or more is less than 5% in an arbitrary section of the casted aluminum alloy.

Like the casted aluminum alloy obtained by the production method of the first invention, it is possible to produce such a casted aluminum alloy at a low cost, and the casted aluminum alloy is excellent in strength, formability, corrosion resistance, and softening resistance.

In general, in an alloy having a similar composition to that of the casted aluminum alloy of the fifth invention, a crystallizate formed of an intermetallic compound of Al, the second component element, and the third component element and having a particle diameter of 5 μm or more is easily generated during casting. Such crystallizate generated in a large amount may cause a reduction in strength when hot rolling, annealing, or the like is performed.

In the casted aluminum alloy of the fifth invention, the area ratio of the crystallizate having the particle diameter of 5 μm or more is less than 5% in an arbitrary section of the casted aluminum alloy. In other words, a content of the crystallizate formed of an intermetallic compound of Al, the second component element, and the third component element is remarkably small, and the second component element and the third component element are dissolved into the Al matrix in the α phase. Therefore, even when the hot rolling, annealing, and the like are performed on the casted aluminum alloy, the strength of the casted aluminum alloy is not reduced but rather the strength is improved.

The casted aluminum alloy of the fifth invention is obtained by the production method of the first invention, for example. In the production method of the first invention, the aluminum alloy having the specific composition is cooled to the specific temperature at the specific cooling rate as described above. Therefore, the crystallizate is suppressed from being generated in the α phase, thereby making it possible to maintain the area ratio of the crystallizate to less than 5% as described above.

A sixth invention is an aluminum alloy material characterized by comprising:

0.8 to 5 mass % of Fe as a first component element, 0.15 to 1 mass % of Ti as a second component element, one or more kinds of third component elements selected from a third component element group consisting of Zr, Nb, Hf, Sc, and Y at a content of 0.05 to 2 mass % of each of the third components and in an amount that satisfies Fe>X>Ti when the content of the first component element Fe is Fe (mass %), the content of the second component element Ti is Ti (mass %), and a total content of the third component elements is X (mass %); and a residual part comprising Al and inevitable impurities, wherein the aluminum alloy material has a metal structure including an α phase that is formed of an Al matrix and a layered phase that is formed of an eutectic structure of the Al matrix and an Al—Fe compound in such a manner as to surround the α phase;

the Al matrix is formed of Al and/or a supersaturated solid solution of Al in which the second component element and the third component element are dissolved; and a precipitate formed of an intermetallic compound of Al, the second component element, and the third component element and having a particle diameter of 2 to 500 nm is dispersed in the Al matrix.

The aluminum alloy material of the sixth invention has the specific composition and the metal structure including the α phase that is formed of an Al matrix and the layered phase that is formed of an eutectic structure of an Al—Fe compound and the Al matrix in such a manner as to surround the α phase. In the Al matrix, a precipitate formed of an intermetallic compound of Al, the second component element, and the third component element and having a particle diameter of 2 to 500 nm or less is dispersed. Such an aluminum alloy material is excellent in strength, formability, corrosion resistance, and softening resistance.

In other words, it is possible to produce the aluminum alloy material of the sixth invention by performing heating, rolling, and the like, for example, on the casted aluminum alloy obtained by the production method of the first invention and the casted aluminum alloy of the fifth invention. It is possible to precipitate the second component element and the third component element dissolved in the Al matrix of the casted aluminum alloy as the fine precipitate by the heating, rolling, and the like. As a result, the casted aluminum alloy exhibits the excellent strength, formability, corrosion resistance, and softening resistance.

More specifically, the aluminum alloy material of the sixth invention can be obtained by the methods for producing of the second to fourth inventions.

BEST MODE FOR CARRYING OUT THE INVENTION

Figure 1:
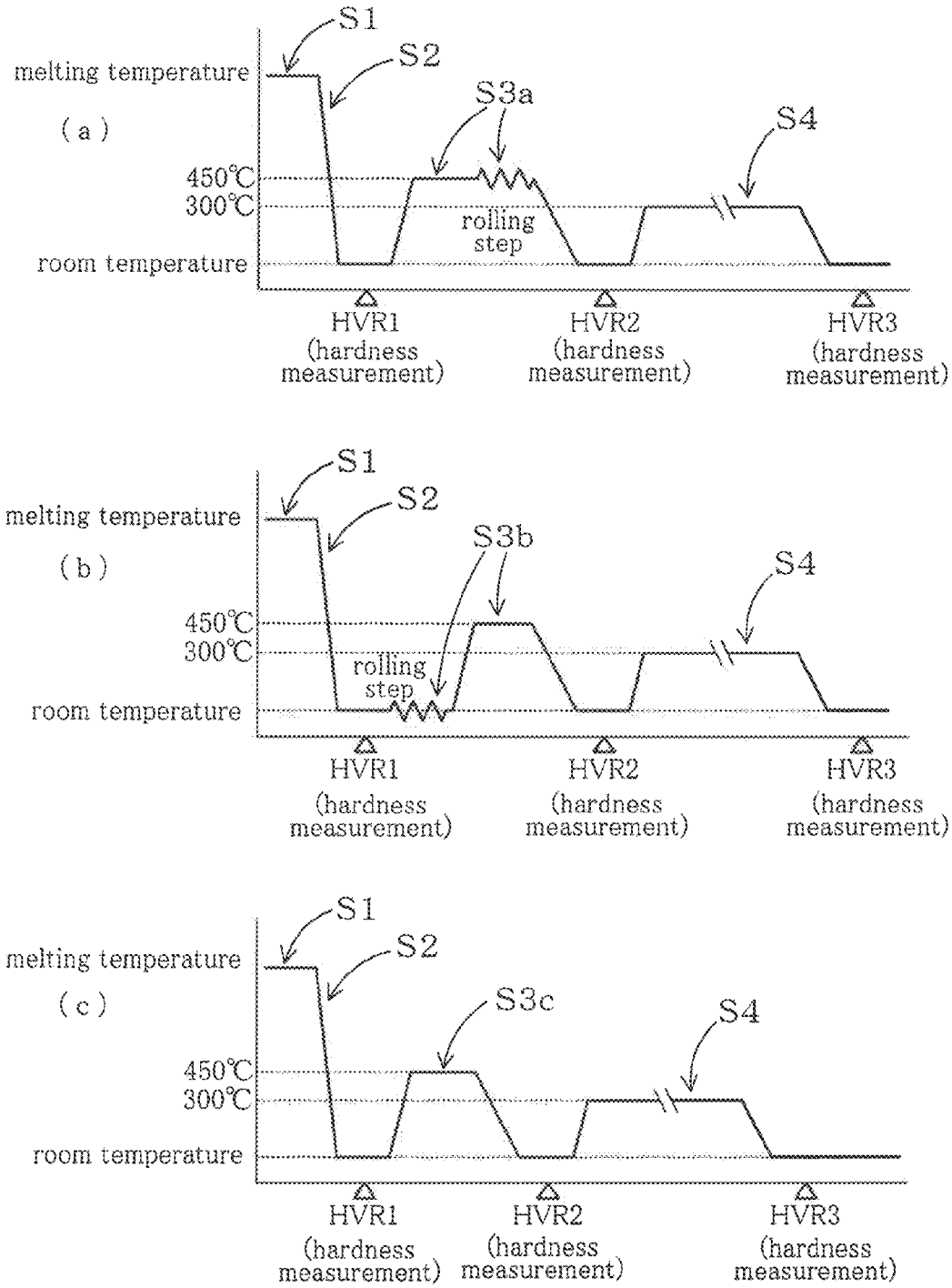
FIG. 1 is an explanatory diagram showing a melting step, a casting step, a post-treatment step, and a heating step as well as measurement timings of hardness HVR1 to 3 in Embodiment 1, wherein (a) is an explanatory illustration of a case of performing a hot rolling step as the post-treatment step, (b) is an explanatory illustration of a case of performing a cold rolling-heating step as the post-treatment step, and (c) is an explanatory illustration of a case of performing a heat treatment step as the post-treatment step.

Hereinafter, preferred mode of the present invention will be described.

In the production method of the first invention, the casted aluminum alloy is produced by performing the melting step and the casting step. The casted aluminum alloy is produced by a casting method of casting a molten metal of an aluminum alloy while supplying the molten metal to a casting mold.

It is preferable that the casting step is performed by continuous casting.

In this case, the casted aluminum alloy can be continuously and directly cast from the molten metal. In this case, it is possible to prominently exhibit the above-described effect of obtaining a casted aluminum alloy excellent in strength, formability, corrosion resistance, and softening resistance even when a direct casting is performed. Also, in this case, it becomes easy to perform the cooling at the specific cooling rate.

Alternatively, the casting step may be performed by a method other than the continuous casting, such as die casting.

In the melting step, used is an aluminum alloy containing the first component element, the second component element, and the third component element and having a residual part formed of aluminum and inevitable impurities.

The aluminum alloy contains 0.8 to 5 mass % of Fe as the first component element.

In the case of adding Fe to an aluminum alloy, strength and strength at a high temperature (heat resistance) are improved. From the viewpoint of metal structure, a layered phase is formed by an Al—Fe compound and Al.

In the case where Fe is less than 0.8 mass %, satisfactory strength is not achieved, which may lead to a reduction in strength under high temperature environment, i.e. in heat resistance. In the case where Fe exceeds 5 mass %, properties become subject to change greatly corresponding to the cooling rate, and a problem of difficulty in stable producing cast material having certain properties occurs. More specifically, in the case of performing rolling, for example, the casted aluminum alloy may become subject to crack. In this case, bulk crystallizate is easily formed during casting to raise a possibility of deterioration in processability and formability. The content of the first component element Fe may preferably be 2.0 to 4.0 mass %, more preferably 3.0 to 4.0 mass %.

0.15 to 1 mass % of Ti is contained as the second component element.

In the case of adding the second component element Ti together with the third component element, it is possible to refine the alloy structure as well as to further improve strength properties because a supersaturated solid solution obtained during solidification from a dissolved state is precipitated in an aluminum parent phase in the case where hot rolling is performed or in the case where a heat treatment is performed after cold rolling.

In the case where Ti is less than 0.15 mass %, satisfactory heat resistance and softening resistance may not be achieved. In the case where Ti exceeds 1 mass %, a bulk Al—Ti crystallizate is easily formed during casting, and processability and formability may be deteriorated. The content of the second component element Ti may preferably be 0.3 to 0.9 mass %, more preferably be 0.7 to 0.8 mass %.

As the third component element, one or more kinds of elements selected from a third component element group consisting of Zr, Nb, Hf, Sc, and Y is/are contained, and the content of each of the elements is 0.05 to 2 mass %.

The third component element exhibits an effect of improving softening resistance when added together with the first component element Fe and the second component element Ti. Specifically, in the case where the first component element Fe is added to the aluminum alloy, the layered phase is formed by the Al—Fe compound and the Al matrix as described above. Further, when the second component element Ti and the third component element are added in the specific amounts, a stable compound (intermetallic compound) phase formed of Al, Ti, and the third component element is formed in an aluminum parent phase when heat energy or strain energy is applied, thereby making it possible to improve the strength properties and the softening resistance. Therefore, the strength is improved in the case where heating is performed after hot rolling or cold rolling. Likewise, the strength improvement effect can be achieved in the case of performing only a heat treatment without performing rolling.

In the case where the content of each of the third component elements is less than 0.05 mass %, the above-described effects that should be achieved by the addition of the third component element may not be satisfactorily achieved. In the case where at least one of the third component elements exceeds 2 mass %, a large crystallizate is easily generated when the cooling rate is not satisfactorily high, and processability and formability may be deteriorated. Therefore, production can be made difficult. The content of each of the third component element groups may preferably be 0.2 to 1.2 mass %, more preferably be 0.5 to 1.2 mass %.

The total content X (mass %) of the third component elements satisfies Fe>X>Ti when the content of the first component element Fe is Fe (mass %) and the content of the second component element Ti is Ti (mass %) in the aluminum alloy.

In the case of X≧Fe, there is a possibility of a reduction in strength of the casted aluminum alloy and a reduction in softening resistance. In the case of X≧Ti, softening resistance may be deteriorated. In the case of Fe≧Ti, there is a possibility of a reduction in strength of the casted aluminum alloy and a reduction in softening resistance.

In the melting step, it is preferable to use the aluminum alloy at least containing 0.2 to 1.2 mass % of Zr among the third component element group.

In this case, it is possible to further improve the softening resistance while maintaining the excellent strength properties and formability.

In the case where the content of Zr is less than 0.2 mass %, the above-described effects that should be achieved by the addition of Zr may not be satisfactorily achieved. In the case where the content exceeds 1.2 mass %, there is a possibility of a remarkable increase in melting temperature when melting the aluminum alloy in the melting step. Since a special device will be required for melting, the production cost can be increased.

In the melting step, it is preferable to use the aluminum alloy further containing 0.05 to 2 mass % of Mg as a fourth component element.

In this case the strength of the casted aluminum alloy substantially can be further improved without impairing the formability. In the case where Mg is less than 0.05 mass %, a strength improvement effect that should be achieved by the addition of Mg is not satisfactorily achieved, and the significance of the Mg addition can be almost lost. In the case where Mg is added in an amount exceeding 2 mass %, processability of the casted aluminum alloy is deteriorated, which may cause generation of rolling crack during rolling, for example. Also, formability can be deteriorated. The content of the fourth component element Mg may preferably be 0.2 mass % to 1.5 mass %, more preferably be 0.3 mass % to 0.8 mass %.

In the melting step, it is preferable to use the aluminum alloy further comprising 0.05 to 1 mass % of at least one fifth component element selected from a fifth component element group consisting of Cu, Cr, and Co.

In the case of containing Cu among the fifth component element group, the strength is improved substantially without impairing the processability of the casted aluminum alloy. Also, in the case of containing Cr and/or Co among the fifth component element group, an Al—(Fe, Cr) compound and/or an Al—(Fe, Co) compound is formed, thereby making it possible to improve elongation property, processability, and formability as compared with those achieved by dispersion of an Al—Fe compound alone. As a result, the strength of the casted aluminum alloy is improved substantially without impairing the processability, formability, and the like.

In the case where the fifth component element is less than 0.05 mass %, the above-described effect that should be achieved by the addition of the fifth component element may not be satisfactorily achieved. In the case where Cu among the fifth component element group is added in an amount exceeding 1 mass %, processability and formability may be deteriorated. Also, in this case, corrosion resistance may be deteriorated. Also, in the case where Cr and/or Co among the fifth component element group is added in an amount exceeding 1 mass %, formability may be deteriorated. The content of the fifth component element may more preferably be 0.1 to 0.7 mass %, yet more preferably be 0.1 to 0.5 mass %.

In the case of containing two or more kinds of the fifth component elements, a total amount thereof may preferably be within the range of 0.05 to 1 mass %.

In the melting step, it is preferable to use the aluminum alloy further containing V and/or Mo as a sixth component element in an amount of more than 0.05 mass % and less than 0.5 mass %.

In this case, the strength is improved substantially without impairing the processability and formability of the casted aluminum alloy.

In the case where the sixth component element is 0.05 mass % or less, the effect that should be achieved by the addition of the sixth component element may not be satisfactorily achieved. In the case of adding 0.5 mass % or more, there is a possibility of a considerable increase in melting temperature. Also, a bulk crystallizate is easily formed, and processability and formability may be deteriorated. The content of the sixth component element may more preferably be 0.1 to 0.4 mass %, yet more preferably be 0.1 to 0.3 mass %. In the case of containing two or more kinds of the sixth component elements, a total amount thereof may preferably be within the range of from more than 0.05 mass % to less than 0.5 mass %.

In the aluminum alloy, it is preferable that a total amount of the fourth component element, the fifth component element, and the sixth component element is maintained to 3 mass % or less.

In the case where the total amount of the fourth to sixth component elements exceeds 3 mass %, the processability of the casted aluminum alloy is deteriorated, which may cause generation of rolling crack during rolling, for example. In this case, a crystallizate is easily generated during the casting step to raise a possibility of deterioration in formability.

In the present invention, a specific gravity of the aluminum alloy of the alloy composition having the particularly highly excellent strength, softening resistance, corrosion resistance, and formability is 2.7 g/cm$^3$.

In the melting step, the aluminum alloy is molten at a temperature that is higher by 20° C. than a liquidus temperature determined by the composition (liquidus temperature +20° C. or more) to obtain the molten metal.

In the case where the melting temperature is a temperature that is less than the liquidus temperature +20° C., it is difficult to achieve satisfactory melt fluidity, and a porosity is formed inside the casted aluminum alloy after the casting, thereby raising a possibility of failing to obtain strong casted aluminum alloy.

Subsequently, in the casting step, the molten metal is cast into a plate-like shape while being cooled to a temperature that is lower by 10° C. than a solidus temperature determined by the aluminum alloy composition, i.e. that is lower than the solidus temperature by at least −10° C., at a cooling rate of 150° C./sec. or more and less than 10000° C./sec. to obtain the casted aluminum alloy.

In this case, the casted aluminum alloy excellent in the properties, such as softening resistance as described above can be obtained, and the strength can be further improved by precipitation of a stable compound (intermetallic compound) phase formed of Al, Ti, and the third component element in the aluminum parent phase (the α phase) when heat energy or strain energy, for example, is applied. Also, since it is possible to suppress formation of a crystallization phase containing a bulk Al—Fe compound or other elements, reductions in ductibility, toughness, and the like can be prevented. Therefore, the properties, such as softening resistance is improved without impairing the processability, formability, and the like.

In the case where the cooling rate in the casting step is less than 150° C./sec., a bulk crystallizate is formed during a solidifying process to raise a possibility of deterioration in formability and reductions in strength properties and softening resistance. Also, since it is necessary to use a special device in order to realize a cooling rate exceeding 10000° C./sec., production cost can be increased. In the case of attaining the cooing rate exceeding 10000° C./sec., it is necessary to shape the casted aluminum alloy after the casting into the form of a ribbon or a powder. Therefore, when performing composition processing, such as rolling, a preliminary molding step is required in advance.

Therefore, by defining the cooling rate of 150° C./sec. or more and less than 10000° C./sec. as in the present invention, the high quality casted aluminum alloy can be produced at industrially realizable low cost. Also, with the cooling rate within the defined range of the present invention, an amorphous phase is substantially absent in a section of the casted aluminum alloy, and it is possible to obtain the casted aluminum alloy having high heat stability with which a change in properties, for example, which can be caused near a crystallization temperature hardly occurs.

In the casting step, in the case where the cooling at the cooling rate is not performed to the temperature that is −10° C. from the solidus temperature, a cast material at a downstream is locally re-molten due to heat of the molten metal at an upstream during the continuous casting, which may cause a bulk crystallizate to be generated. Therefore, there is a possibility that a metal structure of the casted aluminum alloy to be obtained becomes non-uniform.

It is sufficient when the cooling at the cooling rate (150° C./sec. or more and less than 10000° C./sec.) is performed until reaching to the temperature of −10° C. from the solidus temperature, and, once reaching to the temperature, the cooling may be performed at a temperature deviated from the cooling rate of 150° C./sec. or more and less than 10000° C./sec., or may be cooled at the cooling rate within the range. The cooling at the cooling rate (150° C./sec. or more and less than 10000° C./sec.) may preferably be performed until reaching to a temperature that is −100° C. from the solidus temperature.

It is preferable that a copper casting mold is used as the casting mold.

In this case, it is possible to relatively easily realize the range of the cooling rate of 150° C./sec. or more and less than 10000° C./sec. in the casting step.

In the casting step, it is preferable that the molten metal is continuously cast into a plate-like shape having a thickness of 0.3 to 10 mm.

It is possible to perform the casting into plate-like shape by using a casting apparatus of a single roll type, a twin roll type, a block type, a belt type, a wheel type, and the like as described later in this specification.

In the case where the thickness is less than 0.3 mm, it is difficult to pour the molten metal between rolls, blocks, or belts, or to perform gap control, or other operations and the production of the casted aluminum alloy can be made difficult. In the case where the thickness exceeds 10 mm, it is difficult to ensure the above-described cooling rate of 150° C./sec. or more. Also, a fluctuation of the cooling rate can occur, thereby making it difficult to obtain the casted aluminum alloy having uniform characteristic.

In the casting step, it is preferable that the molten metal is continuously cast by using a single roll type, a twin roll type, a block type, a belt type, or a wheel type.

The continuous casting method of single roll type is a method for obtaining a casted aluminum alloy in the form of a plate by continuously supplying the molten metal of the aluminum alloy to a rotational single roll made from copper, for example, and performing rapid solidification. Also, in the continuous casting method of the twin roll type, rotational rolls made from copper are disposed in a pair, and a cooling rate can be controlled by arbitrarily adjusting a gap between the both rolls. The casted aluminum alloy in the form of a plate is obtained by rapid solidification in the same manner as in the single roll method. The block type continuous casting method is a method for supplying the molten metal between two movable block-like cooling members and continuously casting the molten metal into a plate-like shape while cooling and solidifying between the blocks. The belt type continuous casting method is a method for supplying a molten metal between two movable belt-like cooling members and continuously casting the molten metal into a plate-like shape while cooling and solidifying between the belts. The wheel type continuous casting method is a method for pouring a molten metal into a part of a groove formed on an outer peripheral surface of a rotational wheel to allow the molten metal to pass through between the groove and a holding member (wheel) and casting the molten metal into a plate-like shape by continuously withdrawing the molten metal while solidifying the molten metal in a movable casting mold.

In these methods, the range of the cooling rate of 150° C./sec. or more and less than 10000° C./sec. can be realized as well as to produce the casted aluminum alloy with excellent productivity.

In the casting step, it is possible that the molten metal is cast into the plate-like shape, and at least a surface layer of the molten metal is cooled and solidified in the casting mold, and then cooling by water cooling.

In this case, it is possible to use a rotational roll having a small diameter when performing the casting by the single roll or the twin roll type continuous casting method, for example. In other words, a contact area and a contact time between the roll (casting mold) and the molten metal become insufficient when the rotational roll having small diameter is used, thereby making it difficult to cool the molten metal to the temperature of −10° C. from the solidus temperature at the cooling rate. In contrast, when the water cooling is performed subsequently to the molten metal of which at least the surface layer is solidified in the casting mold, it is possible to much more reliably perform the cooling to the temperature of −10° C. from the solidus temperature at the cooling rate even when the roll diameter of the rotational roll is small.

It is possible to perform various post-treatments for applying heat energy and/or strain energy to the casted aluminum alloy to be obtained after the casting step.

More specifically, as in the second invention, it is possible to perform a hot rolling step of reducing the thickness of the casted aluminum alloy by 30% or more by performing hot rolling processing at a temperature of 200° C. or more on the casted aluminum alloy after the casting step.

In this case, not only the α phase and the layered phase formed of the eutectic structure of the Al—Fe compound and Al are formed in the aluminum alloy material, but also the stable compound (precipitate) phase formed of Al, Ti (the second component element), and the third component element is formed in the Al matrix by the heat energy and the strain energy as described above. Therefore, the aluminum alloy material can be obtained by further improving the strength of the casted aluminum alloy. The aluminum alloy material of the sixth invention can be obtained by performing the above-described hot rolling step.

In the case where the temperature for heating the casted aluminum alloy is less than 200° C., rolling crack and a large cracked edge may be generated. Such crack generation is prominent particularly in the case of using an aluminum alloy having a high solute concentration. Also, there is a possibility of failing to satisfactorily develop the characteristic of the aluminum alloy material that the strength is improved by heat energy. This may result in failing to satisfactorily improve the strength of the aluminum alloy material after the above-described hot rolling step.

In the hot rolling step, rolling processing for reducing 30% or more of the thickness of the casted aluminum alloy to be obtained after the casting step is performed. In the case where the reduction is less than 30%, the strain energy becomes insufficient, resulting in failing to satisfactorily improve the strength.

It is preferable that the hot rolling step is performed after casting the molten metal into a plate-like shape in the casting mold while cooling the molted product to a temperature of 200° C. to 500° C. and releasing from the casting mold in the casting step.

In this case, it is possible, without heating, to use in the hot rolling step the casted aluminum alloy as it is which is obtained after the casting step and has the temperature of 200° C. to 500° C. Also, in the case where additional heating is required in the hot rolling step, the heating time can be shortened. Therefore, the number of steps and the production time can be reduced, thereby making it possible to achieve reduction in production cost.

In the case where the temperature of the casted aluminum alloy after the casting step is less than 200° C., it is necessary to heat the casted aluminum alloy again to the temperature of 200° C. or more in the hot rolling step. In the case where the temperature of the casted aluminum alloy after the casting step exceeds 500° C., on the other hand, the Al—Fe compound in the layered phase becomes a bulk, thereby raising a possibility of a reduction in strength. Also, in this case, the service life of a roll can be shortened due to an increase in damage to the roll in the hot rolling step.

In the range of the aluminum alloy composition to be used in the present invention, the above-described "temperature which is lower than the solidus temperature by at least 10° C." never be under the above-described 500° C. or lower. Therefore, even when the cooling to 500° C. is performed in the casting step, the cooling to the "temperature which is lower than the solidus temperature by at least 10° C." is satisfactorily ensured. Also, when high temperature annealing at 450° C.×1 h is performed after the hot rolling, the softening resistance is no longer changed.

As in the third invention, it is possible to perform a cold rolling-heating step of reducing the thickness of the casted aluminum alloy by 30% or more by performing cold rolling on the casted aluminum alloy after the casting step and heating the casted aluminum alloy at a temperature from a temperature which is ½ or more of a melting point of the aluminum alloy to 550° C. or less.

In this case, too, the aluminum alloy material can be obtained by further improving the strength of the casted aluminum alloy by the heat energy and the stain energy in the same manner as in the above-describe hot rolling step.

In the case where the heating temperature of the casted aluminum alloy is less than ½ of the melting point of the aluminum alloy, which may lead to failing to satisfactorily develop the characteristic of the casted aluminum alloy that the strength is improved by the heat energy. This may result in failing to satisfactorily improve the strength of the casted aluminum alloy after the cold rolling and heating. In the case where the heating temperature exceeds 550° C., there is a possibility of formation of a bulk compound and local melting of the composition. This may results in a reduction in properties, such as strength of the aluminum alloy material. In order to further improve the strength, the heating temperature in the cold rolling-heating step may preferably be 400° C. to 500° C., more preferably be 400° C. to 450° C.

It is possible to produce the aluminum alloy material of the sixth invention also by the above-described cold rolling-heating step.

As in the fourth invention, it is possible to perform a heat treatment step of heating the casted aluminum alloy after the casting step at a temperature of 400° C. or more for 0.5 to 3 hours.

In this case, too, it is possible to precipitate a stable compound phase formed of Al, Ti (the second component element), and the third component element in the Al matrix by heat energy. Therefore, the aluminum alloy material can be obtained by further improving the strength of the casted aluminum alloy.

In the case where the heating temperature of the casted aluminum alloy is less than 400° C. or where the heating time is less than 0.5 hour, it may be impossible to satisfactorily develop the characteristic of the casted aluminum alloy that the strength is improved by the heat energy. This may results in failing to satisfactorily improve the strength of the casted aluminum alloy after the heating. Meanwhile, the strength properties are not enhanced even when heating is performed for over 3 hours, and the advantage of long time heating is hardly achieved. In order to further improve the strength, the heating temperature in the heat treatment step may preferably be 400° C. to 500° C., and the heating time may preferably be 1 to 2 hours.

It is possible to produce the aluminum alloy material of the sixth invention also by the above-described heat treatment step.

In the casted aluminum alloy produced by the first invention, an amorphous phase substantially does not exist on any part other than a surface.

Hereinafter, the fifth and sixth inventions will be described.

Each of the casted aluminum alloy of the fifth invention and the aluminum alloy of the sixth invention contains 0.8 to 5 mass % of Fe as a first component element, 0.15 to 1 mass % of Ti as a second component element, one or more kinds of third component elements selected from a third component element group consisting of Zr, Nb, Hf, Sc, and Y at a content of 0.05 to 2 mass % of each of the third components and in an amount that satisfies Fe>X>Ti when the content of the first component element Fe is Fe (mass %), the content of the second component element Ti is Ti (mass %), and a total content of the third component elements is X (mass %); and a residual part containing Al and inevitable impurities. Significance of criticality of the contents of the component elements are the same as those of the first invention.

A metal structure of each of the casted aluminum alloy and the aluminum alloy material is formed of an α phase that is formed of an Al matrix and a layered phase that is formed of an eutectic structure of the Al matrix and an Al—Fe compound in such a manner as to surround the α phase.

In the fifth invention, the Al matrix is formed of a supersaturated solid solution of Al, and the second component element and the third component element are dissolved into the supersaturated solid solution.

In the sixth invention, the Al matrix is formed of Al and/or a supersaturated solid solution of Al in which the second component element and the third component element are dissolved. In the sixth invention, in the case where the dissolved second component element and the third component element are completely precipitated, the Al matrix is formed of Al.

The second component element and the third component element are not dissolved in the Al—Fe compound in the layered phase but dissolved in the α phase and/or the Al matrix in the layered structure.

In the fifth invention, an area ratio of a crystallizate formed of a compound of Al, the second component element, and the third component element and having a particle diameter of 5 μm or more is less than 5% in an arbitrary section of the casted aluminum alloy. It is preferable that an area ratio of a crystallizate having a particle diameter of 2.5 μm or more is less than 5%, and it is more preferable that the crystallizate substantially is not contained in the α phase.

When the area ratio of the crystallizate having the particle diameter of 5 μm or more is 5% or more, there is a possibility of failing to improve the strength properties and softening resistance when heat energy or strain energy is applied to the casted aluminum alloy by hot rolling or the like.

In the aluminum alloy material of the sixth invention, a precipitate formed of a compound of Al, the second component element, and the third component element and having a particle diameter of 2 to 500 nm is dispersed in the Al matrix. The precipitate is formed in the Al matrix of the α phase, for example. In the case where the particle diameter of the precipitate is less than 2 nm, satisfactory strength may not be achieved. In the case where the particle diameter exceeds 500 nm, there is also a possibility of failing to achieve satisfactory strength.

It is possible to confirm existences of the precipitate in the sixth invention and the crystallizate in the fifth invention by transmission electron microscopic observation, for example. Also, it is possible to investigate the size (particle diameter) of the crystallizate and the precipitate on an arbitrary section of the casted aluminum alloy by microscopic observation. Each of the particle diameters of the crystallizate and the precipitate is defined as a diameter (circle equivalent diameter) of a circle which is estimated to have an area identical to that of the crystallizate or the precipitate in the arbitrary section of the casted aluminum alloy.

Also, an area proportion of the crystallizate in the arbitrary section is measured by: polishing a measurement object surface of the casted aluminum alloy to a mirror surface; observing the measurement object surface by using a transmission electron microscope; and measuring an area ratio of the obtained image by using an image analysis processing device. The area ratio is a proportion of the area of the crystallizate to the observed visual field area in the observed visual field plane. Note that the observed visual field area is at least 1 $mm^2$ or more.

The aluminum alloy material of the sixth invention can be obtained by applying heat energy or strain energy to the casted aluminum alloy obtainable from the production method of the first invention or the casted aluminum alloy of the fifth invention. Thus, it is possible to precipitate as the precipitate each of the second component element and the third component element dissolved into the Al matrix.

In the fifth and sixth inventions, it is preferable that the casted aluminum alloy and the aluminum alloy material may at least contain 0.2 to 1.2 mass % of Zr among the third component element group.

In this case, the softening resistance can be further improved while maintaining the excellent strength properties and formability. Significance of criticality of the content of Zr is similar to that of the first invention.

It is preferable that the casted aluminum alloy and the aluminum alloy material contain 0.05 to 2 mass % of Mg as a fourth component element.

In this case, the strength of the casted aluminum alloy and the aluminum alloy material can be further improved substantially without impairing the formability. Significance of criticality of the content of Mg is similar to that of the first invention.

It is preferable that Mg as the fourth component element is dissolved at least into the Al matrix.

Also, it is preferable that Mg as the fourth component element forms an Al—Mg compound in the Al matrix.

In this case, the strength of the casted aluminum alloy and the aluminum alloy material can yet further be improved.

It is preferable that each of the casted aluminum alloy and the aluminum alloy material contain 0.05 to 1 mass % of at least one fifth component element selected from a fifth component element group consisting of Cu, Cr, and Co. In the case of containing Cu among the fifth component element group, the strength is improved substantially without impairing the processability of the casted aluminum alloy and the aluminum alloy material. Also, in the case of containing Cr and/or Co among the fifth component element group, it is possible to improve the elongation property, the processability, and the formability of the casted aluminum alloy and the aluminum alloy material. Significance of criticality of the content of the fifth component element is similar to that of the first invention.

It is preferable that Cr and/or Co as the fifth component element is substituted with at least a part of the Al—Fe compound forming the layered phase to form an Al—(Fe, Cr) compound and/or an Al—(Fe, Co) compound.

In this case, it is possible to further improve the elongation property, the processability, and the formability of the casted aluminum alloy and the aluminum alloy material.

It is preferable that Cu as the fifth component element forms an Al—Cu compound in the Al matrix.

In this case, it is possible to further improve the strength substantially without impairing the processability of the casted aluminum alloy and the aluminum alloy material.

It is preferable that each of the casted aluminum alloy and the aluminum alloy material contain 0.05 to 2 mass % of Mg as a fourth component element and 0.05 to 1 mass % of Cu as a fifth component element, and that the fourth component element and the fifth component element form an Al—Cu—Mg compound in the Al matrix. In other words, in the case where Mg as the fourth component and Cu as the fifth component element are contained, it is preferable that an Al—Cu—Mg compound is formed in the Al matrix.

In this case, it is possible to yet further improve the strength substantially without impairing the processability of the casted aluminum alloy and the aluminum alloy material.

It is preferable that each of the casted aluminum alloy and the aluminum alloy material contain V and/or Mo as a sixth component element in an amount of more than 0.05 mass % and less than 0.5 mass %.

In this case, the strength substantially is improved without impairing the processability and formability of the casted aluminum alloy and the aluminum alloy material. Significance of criticality of the content of the sixth component element is similar to that of the first invention.

It is preferable that V and/or Mo as the sixth component element forms a compound with Al (Al—V compound and/or Al—Mo compound) and a compound with Al, the second component element Ti, and the third component element X (Al—(V, X, Ti), Al—(Mo, X, Ti)) in the Al matrix.

In this case, it is possible to yet further improve the strength substantially without impairing the processability and formability of the casted aluminum alloy and the aluminum alloy material.

EXAMPLES

Embodiment 1

In the present embodiment, casted aluminum alloys (continuously cast materials) made from aluminum alloys of a plurality of types of compositions were prepared as shown in Table 1 to Table 4, and softening resistance and the like were investigated to clarify superiority of the casted aluminum alloys of the present invention.

Alloy compositions, specific gravities, and cooling rates of the casted aluminum alloys (Examples 1 to 48) within the scope of the present invention are shown in Table 1 and Table 2.

Also, for the purpose of comparison, casted aluminum alloys (Comparative Examples 1 to 20, and Comparative Examples 28 to 37) made from aluminum alloys that are out of the component range defined in the present invention and casted aluminum alloys (Comparative Examples 21 to 27) produced at cooling rates that are out of the range defined in the present invention were prepared. Alloy compositions and specific gravities of these alloys are shown in Table 3 and Table 4.

In the present embodiment, the cooling rate is determined by a speed of a molten metal of each of the aluminum alloys of the different compositions passing through a range of temperatures of ±40° C. from the solidus temperature in the course of cooling the molten metal in the casting step.

In the present embodiment, each of the casted aluminum alloys (Examples 1 to 48, Comparative Examples 1 to 20, and Comparative Examples 28 to 37) was produced by continuous casting, and various post-treatments were performed for the evaluation of softening resistance as shown in FIG. 1.

More specifically, for the production of each of the casted aluminum alloys, a melting step S1 for forming a molten metal by melting the aluminum alloy at a temperature (melting temperature) that is higher by 20° C. than a liquidus temperature determined by each alloy composition and a casting step S2 for obtaining the casted aluminum alloy by: cooling the molten metal to a temperature that is lower than a solidus temperature by at least 10° C. at the cooling rate shown in any one of Table 1 to Table 4; cooling the molten metal to a room temperature; and casting the molten metal into a plate-like shape having a thickness of 1.2 mm were performed as shown in FIGS. 1(*a*) to (*c*). The casting step S2 was performed by the single roll continuous casting method using a copper roll.

Also, a post-treatment step S3 was performed on each of the casted aluminum alloys (Examples 1 to 48, Comparative Examples 1 to 20, and Comparative Examples 28 to 37) obtained after the casting step S2. As the post-treatment step S3, any one of hot rolling step S3*a* (Examples 1 to 36, Examples 41 to 48, Comparative Examples 1 to 20, and Comparative Examples 28 to 37), a cold rolling-heating step S3*b* (Example 37, Example 39, and Example 40), a heat treatment step S3*c* (Example 38) was performed. Types of the post-treatment steps performed on the casted aluminum alloys are shown in Table 1 to Table 4.

In the hot rolling step S3*a*, as shown in FIG. 1(*a*), each of the casted aluminum alloys after the casting step S2 was heated to a temperature of 450° C., and 40% of the thickness thereof was reduced by hot rolling to obtain an aluminum alloy material having a thickness of 0.72 mm. After that, the aluminum alloy material was allowed to cool to a room temperature.

In the cold rolling-heating step S3*b*, as shown in FIG. 1(*b*), cold rolling was performed on each of the casted aluminum alloys after the casting step S2 to reduce a thickness thereof by 40% to obtain an aluminum alloy material having a thickness of 0.72 mm. After that, the aluminum alloy material was heated at a temperature that is ½ of the melting point of the aluminum alloy or more (450° C. in the present invention) for one hour. After that, the aluminum alloy material was allowed to cool to a room temperature.

In the heat treatment step S3*c*, as shown in FIG. 1(*c*), each of the casted aluminum alloys after the casting step S2 was heated at 450° C. for one hour. After that, the aluminum alloy material was allowed to cool to a room temperature.

Further, in the present embodiment, as shown in FIGS. 1(*a*) to 1(*c*), a heating step S4 of maintaining each of the aluminum alloy materials after the post-treatment step S3 to 300° C. for 100 hours (in an assumption of long-term exposure to a temperature region equivalent to an engine traveling environment, for example) and allowing the aluminum alloy materials to cool to a room temperature was performed.

As described above, aluminum alloy materials (Examples 1 to 48, Comparative Examples 1 to 20, and Comparative Examples 28 to 37) on which the post-treatment step S3 and the heating step S4 have been performed were obtained.

In the present embodiment, in order to show superiority of the cooling rate, each of the aluminum alloys having the compositions shown in Table 4 was cast at a cooling rate of 150° C./sec. to obtain an ingot for comparison, and aluminum alloy materials (Comparative Examples 21 to 27) were obtained by rolling the ingots.

Figure 2:
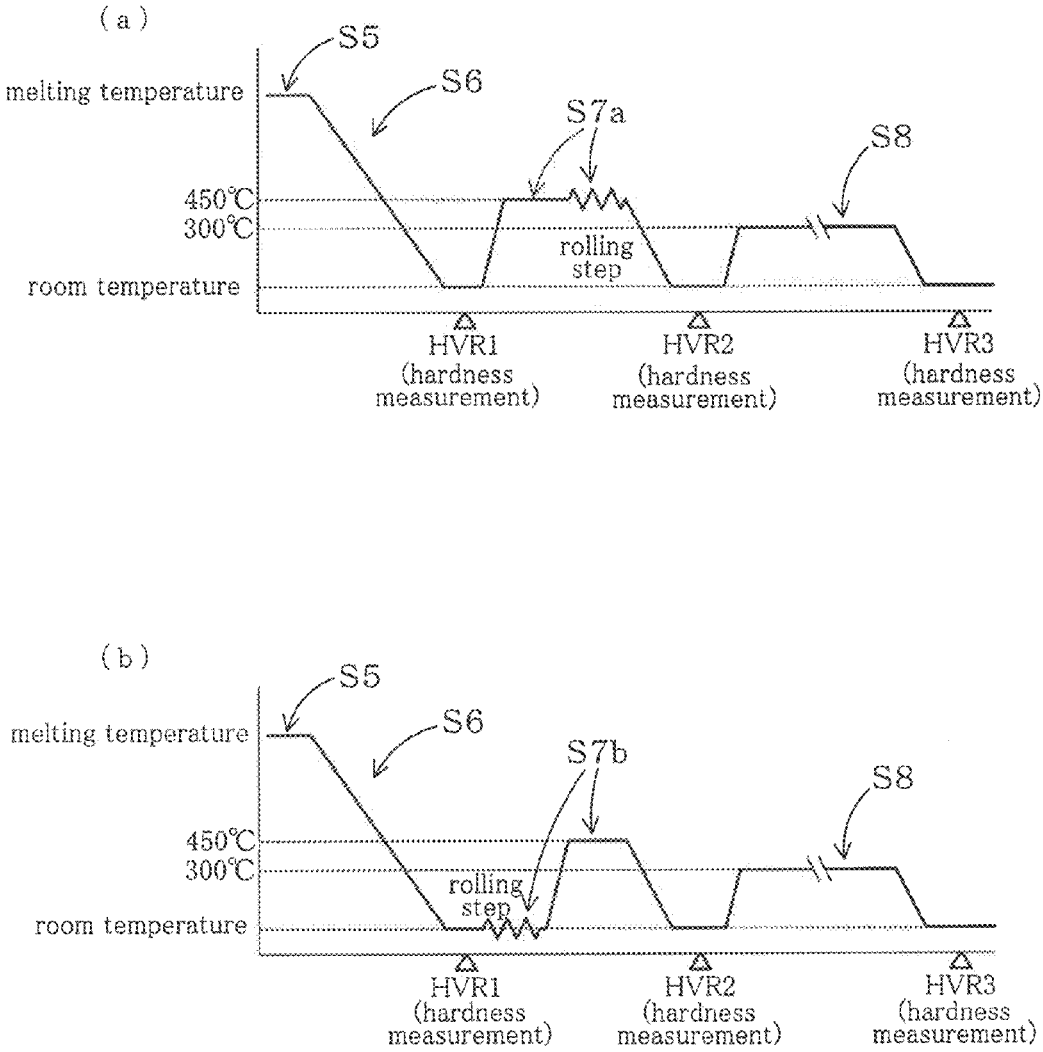
FIG. 2 is an explanatory diagram showing a melting step, a solidifying step, a post-treatment step, and a heating step as well as measurement timings of hardness HVR1 to 3 in Embodiment 1, wherein (a) is an explanatory illustration of a case of performing a hot rolling step as the post-treatment step and (b) is an explanatory illustration of a case of performing a cold rolling-heating step as the post-treatment step.

In other words, as shown in FIG. 2(*a*), for preparing the ingot, a melting step S5 for preparing a molten metal of each of the alloys by melting the alloy at a temperature (melting temperature) that is higher by 200° C. than a liquidus temperature determined by the composition of each alloy and a solidifying step S6 for obtaining an aluminum alloy ingot by solidifying by cooling the molten metal at a cooling rate of 100° C./sec. were performed. By these steps, aluminum alloy ingots each in the form of a plate having a thickness of 1.2 mm were obtained.

After the ingot preparation, a hot rolling step S7*a* or a cold rolling-heating step S7*b* was performed as a post-treatment step S7. More specifically, the hot rolling step S7*a* was performed on Comparative Examples 21 to 23 and Comparative Examples 25 to 27, and the cold rolling-heating step S7*b* was performed on Comparative Example 24.

In the hot rolling step S7*a*, as shown in FIG. 2(*a*), each of the aluminum alloy ingots after the solidifying step S6 was heated to a temperature of 450° C., and 40% of a thickness thereof was reduced by hot rolling to obtain an aluminum alloy material having a thickness of 0.72 mm. After that, the aluminum alloy material was allowed to cool to a room temperature.

In the cold rolling-heating step S7*b*, as shown in FIG. 2(*b*), cold rolling was performed on each of the aluminum alloy ingots after the solidifying step S6 to reduce a thickness thereof by 40% to obtain an aluminum alloy material having a thickness of 0.72 mm. After that, the aluminum alloy material was heated at a temperature that is more than ½ of a melting point of the aluminum alloy (450° C. in the present invention) for one hour and allowed to cool to a room temperature.

As shown in FIGS. 2(*a*) and (*b*), after the post-treatment step S7, a heating step S8 of maintaining each of the aluminum alloy materials to 300° C. for 100 hours (in an assumption of long-term exposure to a temperature region equivalent to an engine traveling environment, for example) and allowing the aluminum alloy material to cool to a room temperature was performed.

As described above, aluminum alloy materials (Comparative Examples 21 to 27) on which the melting step S5, the solidifying step S6, the post-treatment step S7, and the heating step S8 have been performed were obtained.

In Examples 1 to 40 and Examples 1 to 27, hardness HVR1 of the casted aluminum alloy before the post-treatment step S3 (S7), hardness HVR2 of the aluminum alloy material after the post-treatment step S3 (S7) and hardness HVR3 of the aluminum alloy material underwent the post-treatment step S3 (S7) and the heating step S4 (S8) which was performed subsequently to the post-treatment step were respectively measured, and softening resistance was evaluated by way of the change. The HVRn (n: No.) is referred to as residual hardness, and the residual hardness is in general significantly reduced when exposed to a high temperature region exceeding ½ of a material melting point. From such point of view, a casted aluminum alloy that is reduced in hardness reduction after the exposure to high temperature region was investigated.

Figure 3:
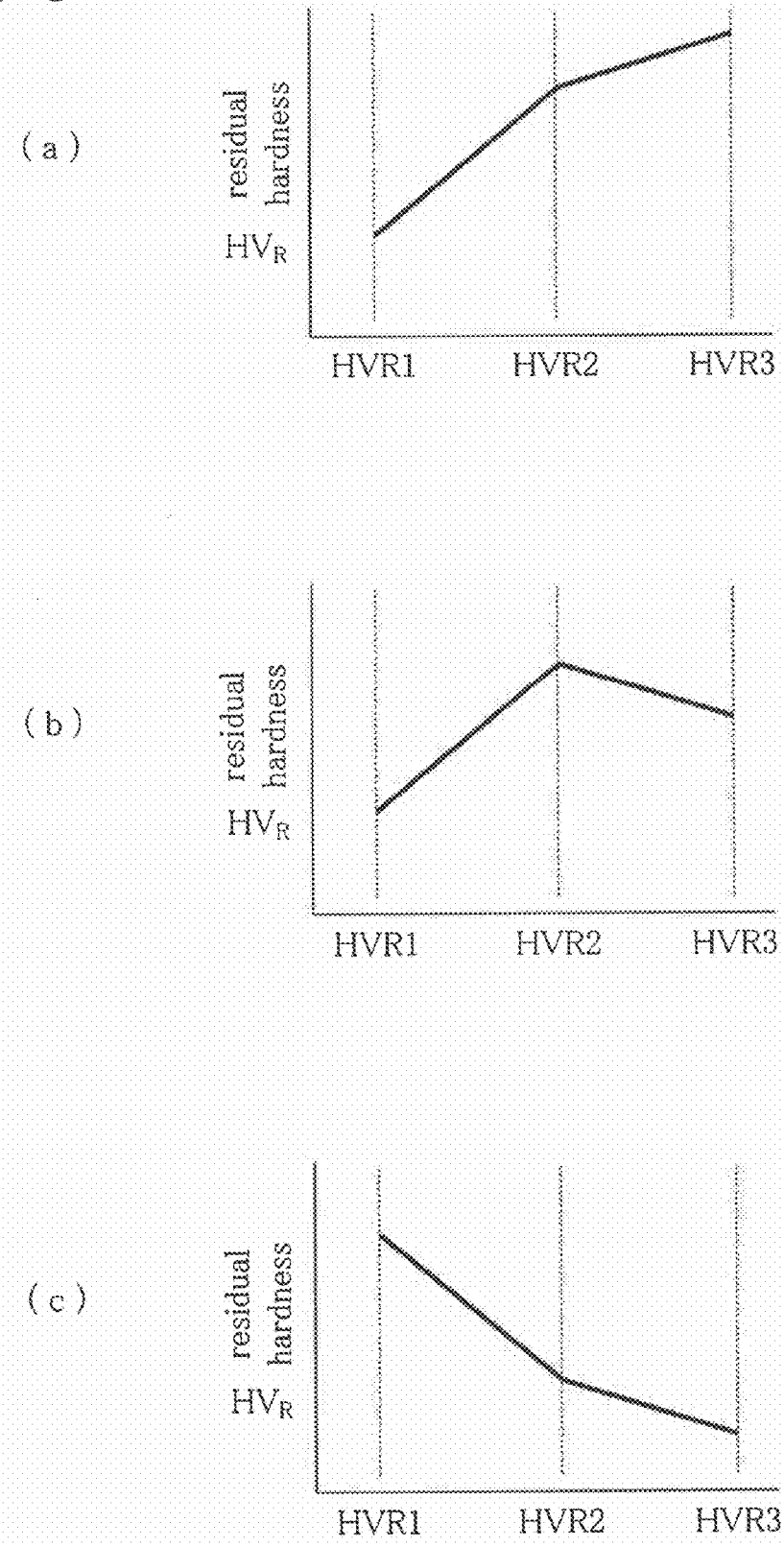
FIG. 3 is an explanatory diagram showing (a) pattern 1, (b) pattern 2, and (c) pattern 3 of hardness behaviors in Embodiment 1.

The softening resistance is determined as follows: a pattern of HVR1<HVR2<HVR3 (pattern 1) is excellent (◎) as shown in FIG. 3(*a*); a pattern of HVR1<HVR2, HVR1<HVR3, and HVR2>HVR3 (pattern 2) is good (○) as shown in FIG. 3(*b*); and other patterns, such as a pattern of HVR1>HVR2>HVR3 (pattern 3) is no good (x) as shown in FIG. 3(*c*). Evaluation results of softening resistance of Examples 1 to 48 and Comparative Examples 1 to 37 are shown in Table 5 to Table 8.

In FIGS. 3(*a*) to (*c*), a horizontal axis is a distinction among HVR1, HVR2, and HVR3, and a vertical axis is Vickers hardness HV.

As is understood from Table 5 and Table 6, each of the casted aluminum alloys of Examples 1 to 48 shows the behavior of the pattern 1 or the pattern 2 of the softening resistance, thereby revealing the excellent softening resistance.

In contrast, as is understood from the results of Table 7 and Table 8, the Al-transition element alloys are classified into "increasing type (◎ or ○)" showing the patterns 1 and 2 of FIGS. 3(*a*) and (*b*) and "decreasing type (x)" of the pattern 3 of FIG. 3(*c*). As shown in Table 7, the decreasing type is a phenomenon observed in general-purpose Al alloys.

In order to investigate the reasons for the above-described excellent softening resistance of the casted aluminum alloys of Examples 1 to 48, changes in alloy structure before and after the hot rolling step of one of the casted aluminum alloys (Example 1) among the above-specified examples were observed by using a scanning electron microscope. A microscope photograph of the alloy structure before hot rolling is shown in FIG. 4, and a microscope photograph of the alloy structure after hot rolling is shown in FIG. 5.

Figure 4:
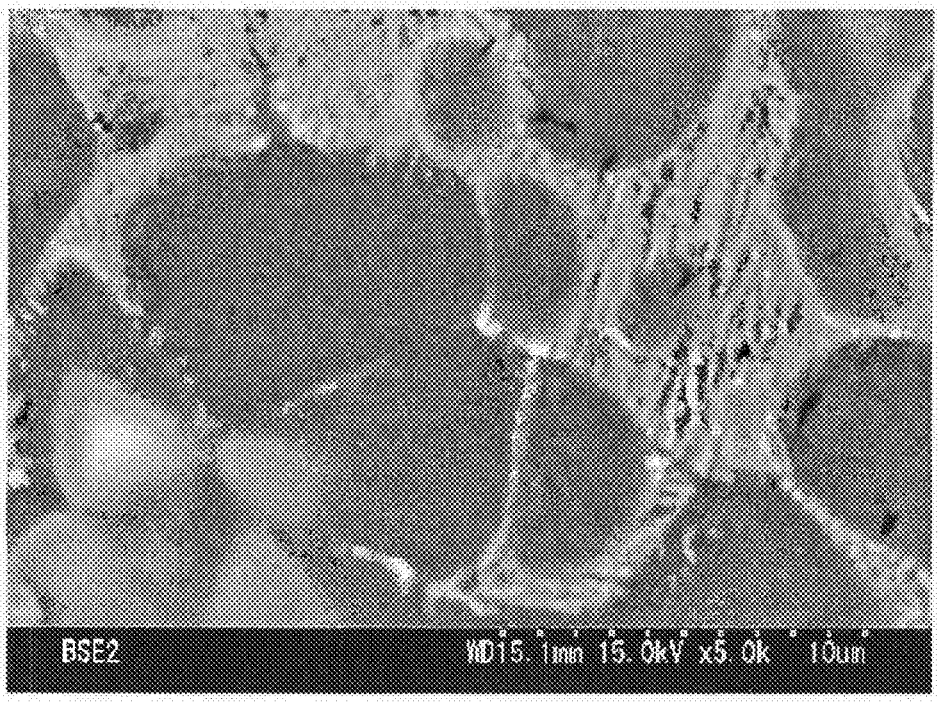
FIG. 4 is an explanatory view showing an alloy structure (Example 11) before hot rolling in Embodiment 1.
Figure 5:
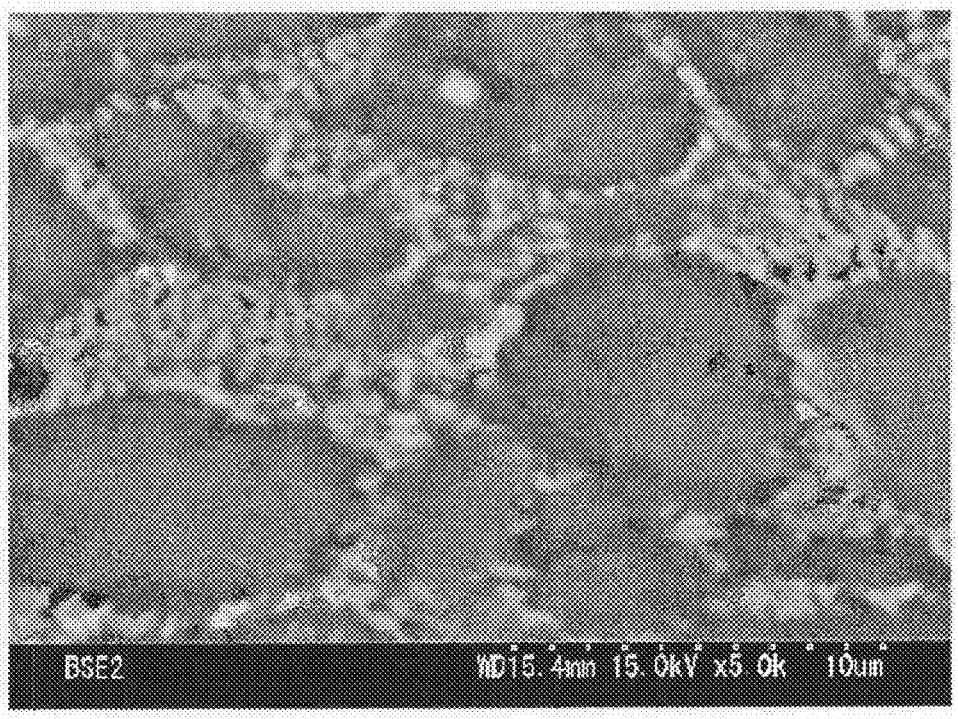
FIG. 5 is an explanatory view showing an alloy structure (Example 11) after hot rolling in Embodiment 1.
Figure 7:
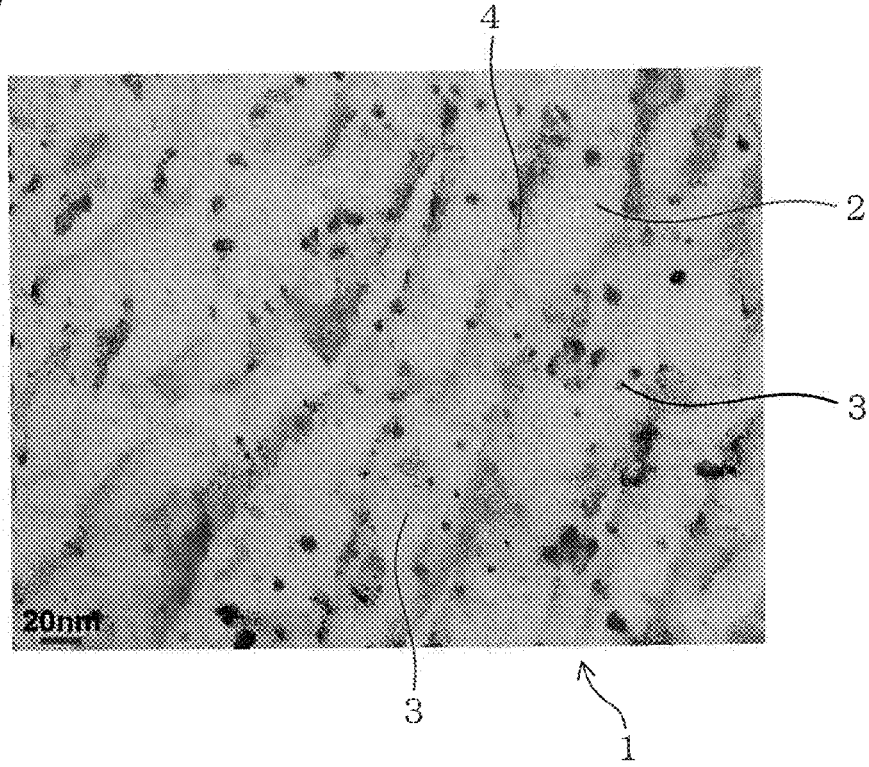
FIG. 7 is an explanatory view showing a state in which a precipitate is formed, which is an SEM photograph of an alloy structure (Example 11) after hot rolling.

As is understood from FIG. 4 and FIG. 5, in metal structures of an α phase formed of an Al matrix and a layered structure formed of an eutectic structure of an Al—Fe compound and an Al matrix, a stable compound phase (precipitate) formed of Al, Ti, and the third component element was precipitated in the Al matrix. The softening resistance is improved by the stable compound phase (precipitate), and it is considered that the strength was improved after the above-described processings and heating and the like. A result (photograph) of observation by the scanning electron microscope of the alloy structure of the aluminum alloy material after the rolling at a magnification different from that of FIG. 5 is shown in FIG. 7. As is understood from FIG. 7, the aluminum alloy material 1 of Example 11 has an α phase 2 formed of an Al matrix and a layered phase 4 formed in such a manner as to surround the α phase. In the alloy structure of the aluminum alloy material 1 (Example 11) after the hot rolling, a precipitate 3 having a particle diameter of about 15 nm or less is generated in the Al matrix.

Figure 8:
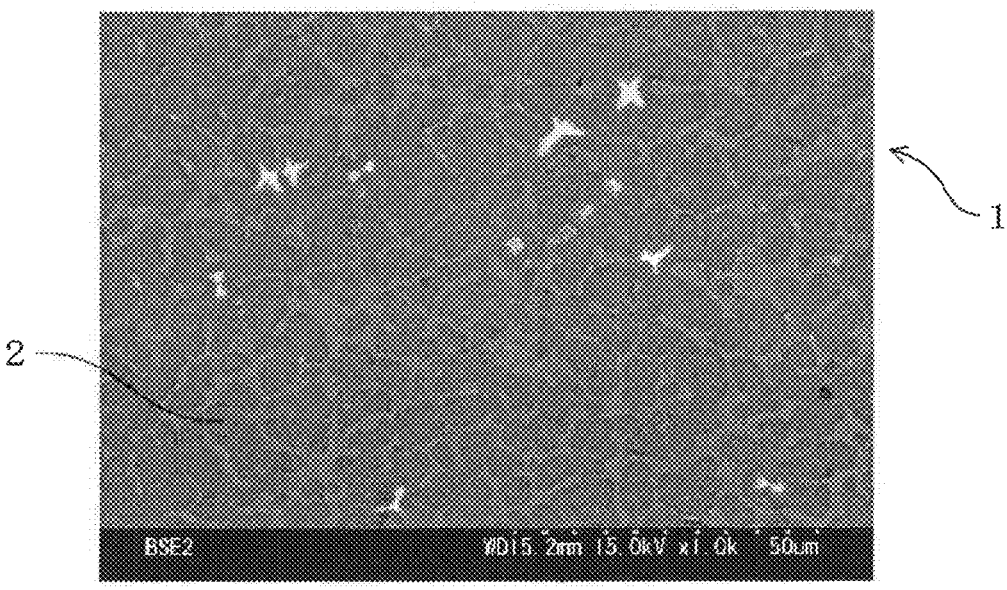
FIG. 8 is an explanatory view showing an SEM photograph (×1000 magnification) of an alloy structure of a casted aluminum alloy (Example 11) before hot rolling in Embodiment 1.
Figure 9:
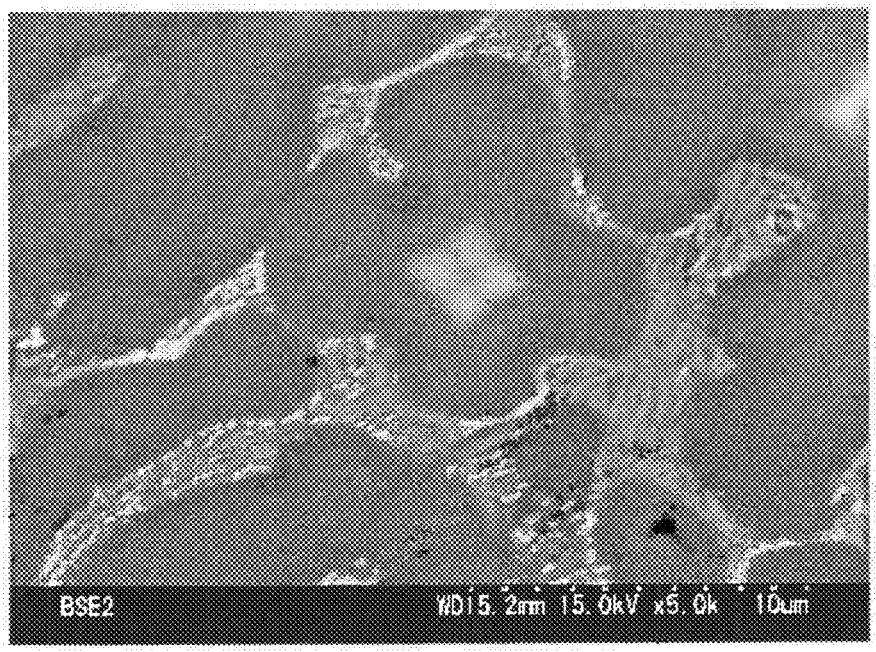
FIG. 9 is an explanatory view showing an SEM photograph (×5000 magnification) of an alloy structure of a casted aluminum alloy (Example 11) before hot rolling in Embodiment 1.

Other photographs by the scanning electron microscope (SEM) of the alloy structure of the casted aluminum alloy of Example 11 before hot rolling are shown in FIG. 8 and FIG. 9. Shown in FIG. 8 is a photograph by SEM at a magnification of ×1000 of observation of the alloy structure of the casted aluminum alloy (Example 11), and shown in FIG. 9 is a photograph by SEM at a magnification of ×5000 of observation of the alloy structure of the casted aluminum alloy (Example 11). FIG. 9 is an enlarged view of a part of FIG. 8 in which a crystallizate was generated.

Figure 10:
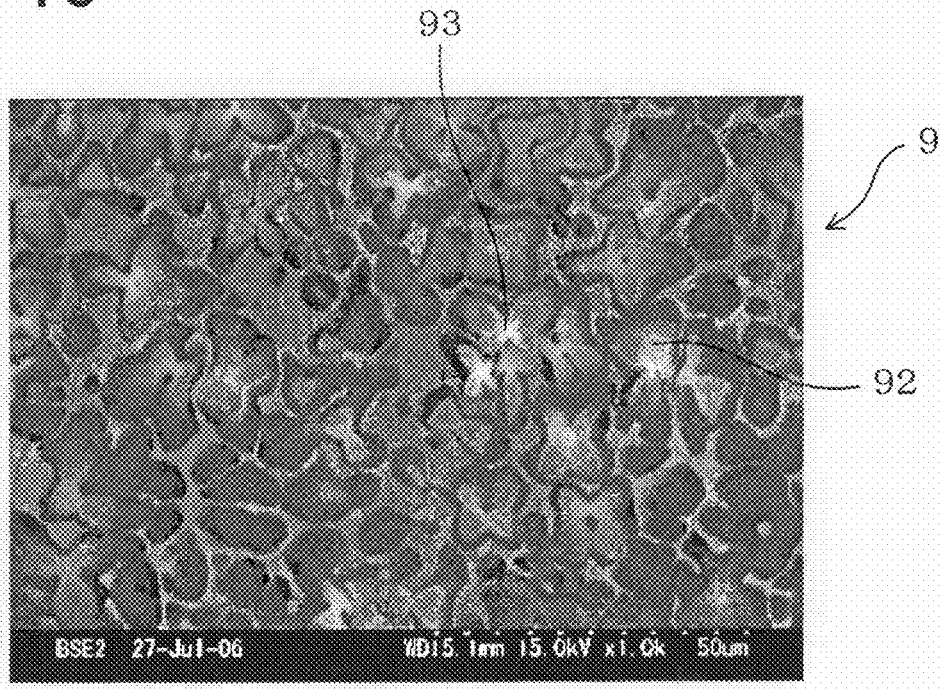
FIG. 10 is an explanatory view showing an SEM photograph (×1000 magnification) of an alloy structure of a casted aluminum alloy (Comparative Example 22) before hot rolling in Embodiment 1.
Figure 11:
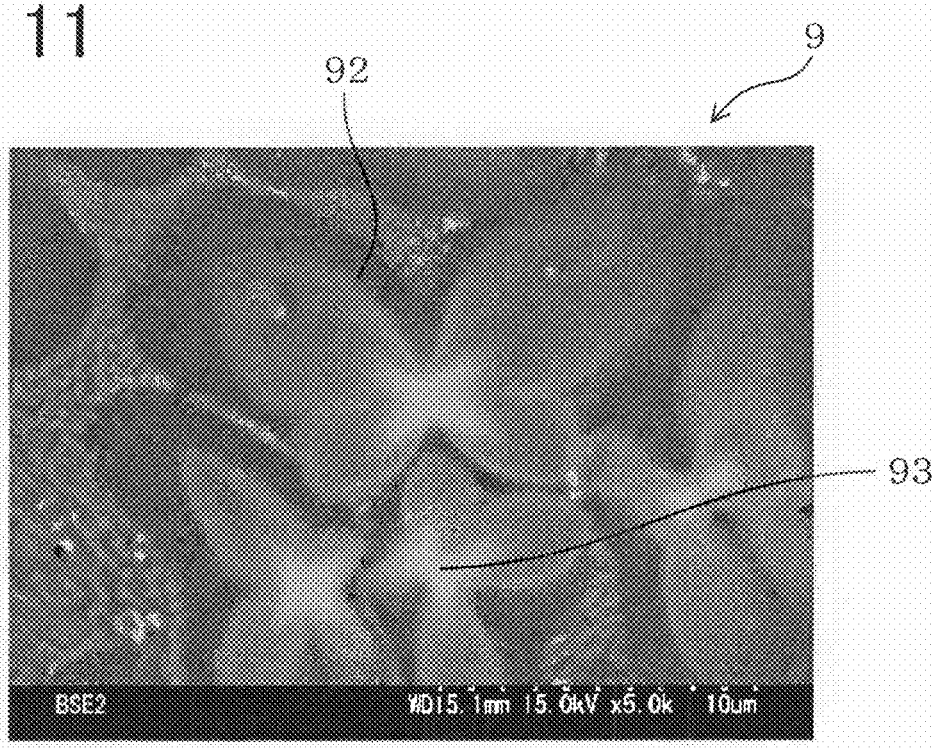
FIG. 11 is an explanatory view showing an SEM photograph (×5000 magnification) of an alloy structure of the casted aluminum alloy (Comparative Example 22) before hot rolling in Embodiment 1.

Also, for the comparison with Example 11, scanning electron microscope photographs of the alloy structure of the casted aluminum alloy of Comparative Example 22 before hot rolling are shown in FIG. 10 and FIG. 11. Shown in FIG. 10 is a photograph by SEM at a magnification of ×1000 of observation of the alloy structure of the casted aluminum alloy (Comparative Example 22), and shown in FIG. 11 is a photograph by SEM at a magnification of ×5000 of observation of the alloy structure of the casted aluminum alloy (Comparative Example 22). FIG. 11 is an enlarged view of a part of FIG. 10 in which a crystallizate was generated.

The scanning electron microscope was S-3600N manufactured by Hitachi, Ltd., and the observation was conducted under the condition of an accelerating voltage of 15 kV.

As shown in FIGS. 8 and 9, in the α phase, there were few crystallizates (compound ($Al_x$(Ti, X)) of Al, the second component element Ti, and the third component element X) having a particle diameter of 5 μm or more in an alloy structure of the casted aluminum alloy of Example 11, and an area ratio of the crystallizate was less than 5%.

In contrast, as is understood from FIG. 10 and FIG. 11, in an alloy structure of the casted aluminum alloy 9 of Comparative Example 22, a relatively large amount of bulk crystallizates 93 (compound ($Al_x$(Ti, X)) of Al, the second component element Ti, the third component element X) having a particle diameter of 5 μm or more was dispersed in an Al matrix of an α phase 92. Also, as is understood from a comparison between FIG. 9 and FIG. 11, the crystallizate generated in Comparative Example 22 was relatively larger than that of Example 11.

Figure 12:
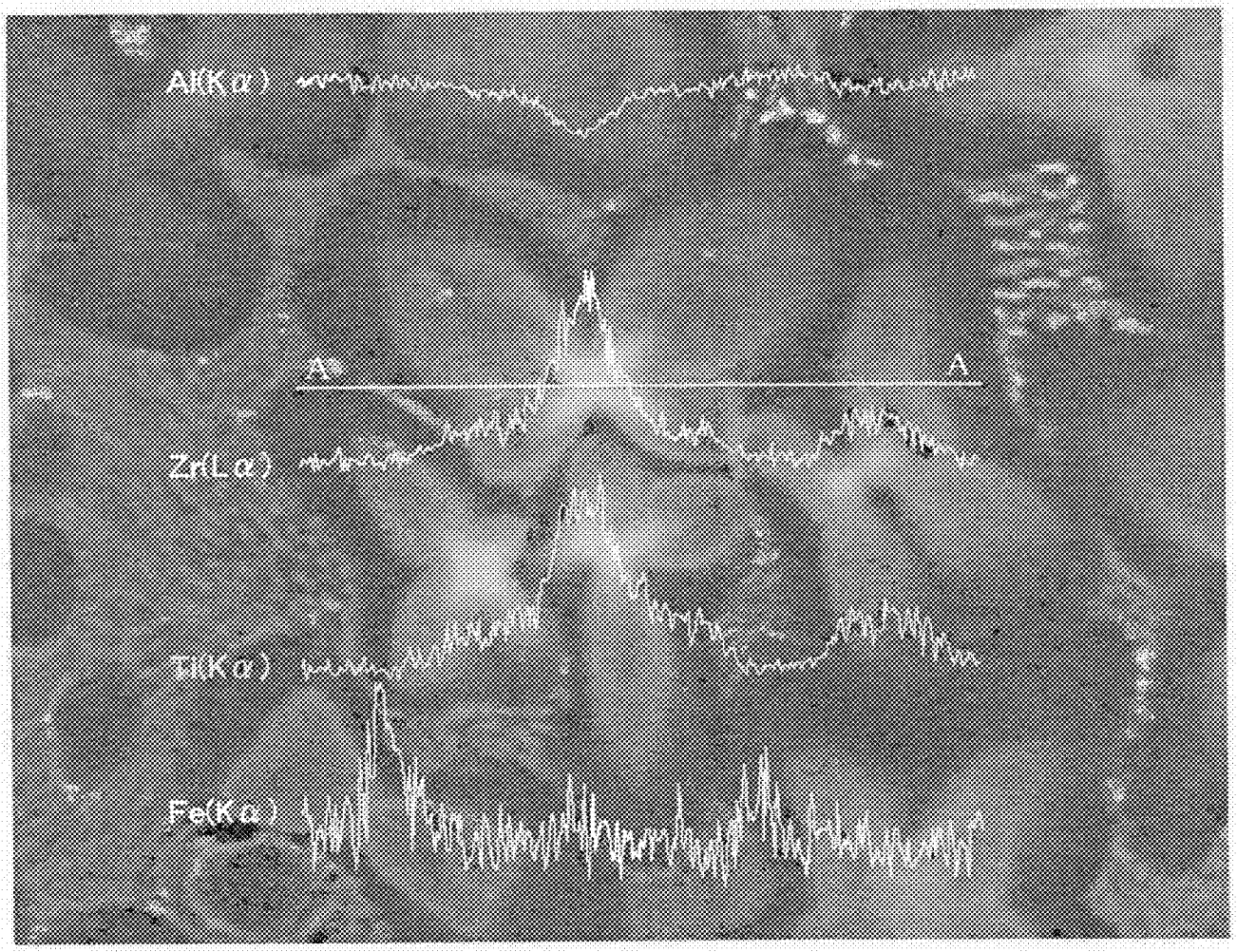
FIG. 12 is an explanatory view showing a component analysis result of a crystallizate of the casted aluminum alloy (Comparative Example 22) before hot rolling in Embodiment 1.

Results of component analysis in a region of the casted aluminum alloy (Comparative Example 22) where the crystallizate was observed are shown (see FIG. 12). In the diagram, relative amounts of each component (Al, Zr, Ti, Fe) in a region indicated by a straight line A-A in a scanning electron microscope photograph of the casted aluminum alloy (Comparative Example 22) are shown as the sizes of peaks. In FIG. 12, a profile by a Kα line is shown for each of Al, Ti, and Fe, and a profile by an La line is shown for Zr. As is understood from FIG. 12, in the crystallizate, large amounts of the second component element Ti and the third component element Zr are present, and a compound of Al, Ti, and Zr is formed. For the analysis of the component amounts, an energy dispersive X ray analysis device manufactured by Edax Japan was used.

Figure 13:
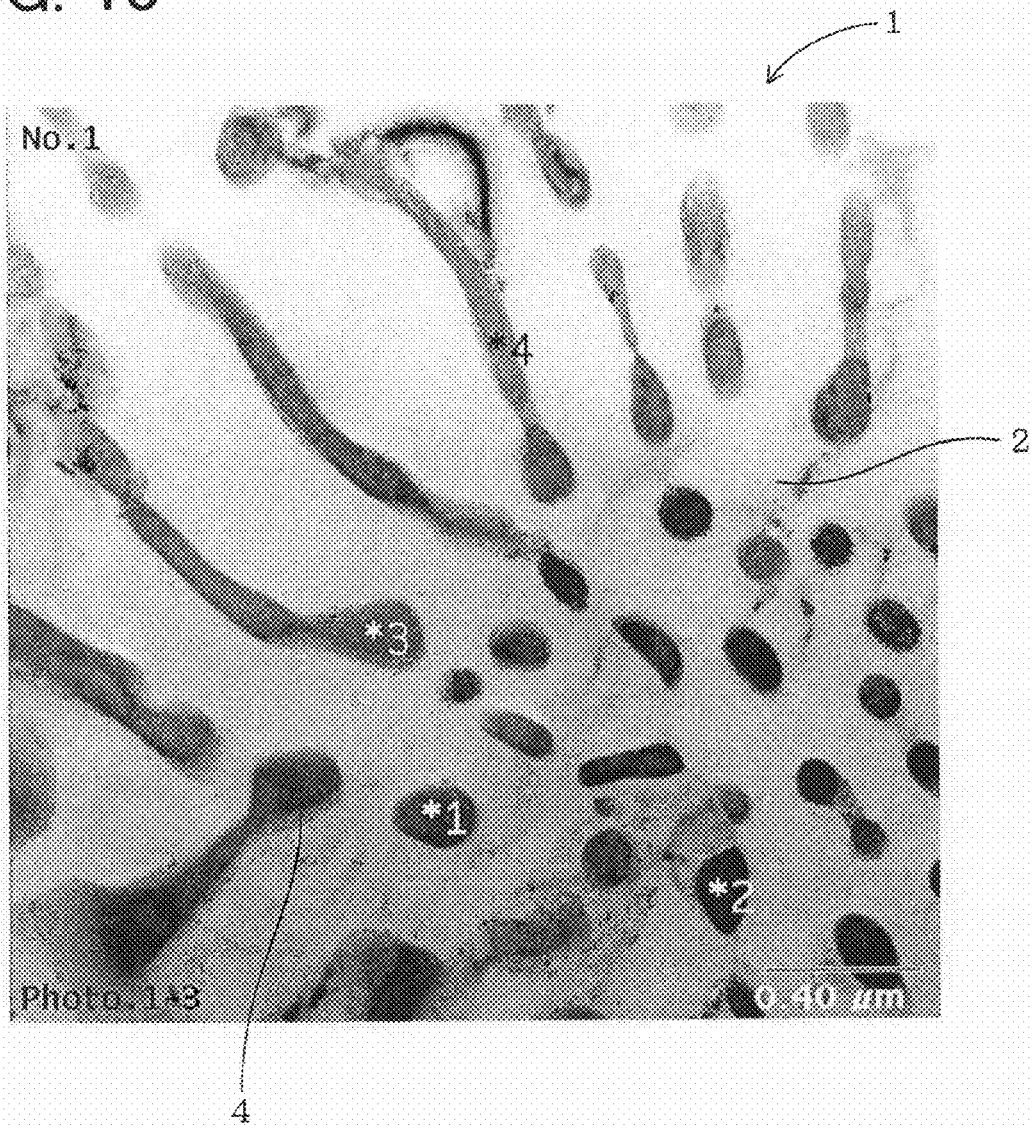
FIG. 13 is an explanatory view showing a TEM photograph of the alloy structure of the casted aluminum alloy (Example 11) before hot rolling in Embodiment 1.
Figure 14:
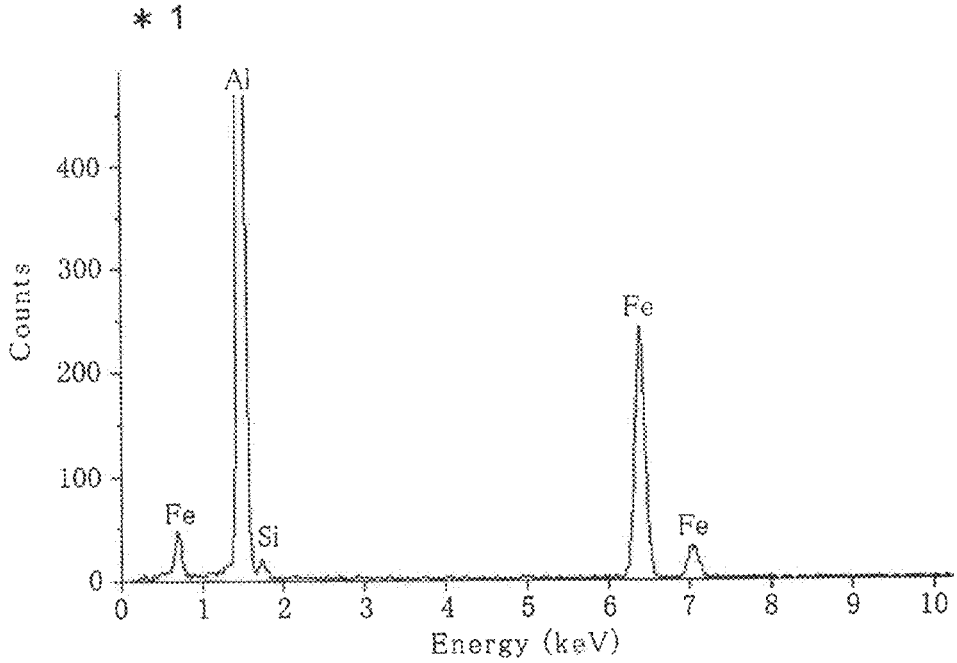
FIG. 14 is an explanatory diagram showing an analysis result of EDX at point *1 in FIG. 13.
Figure 15:
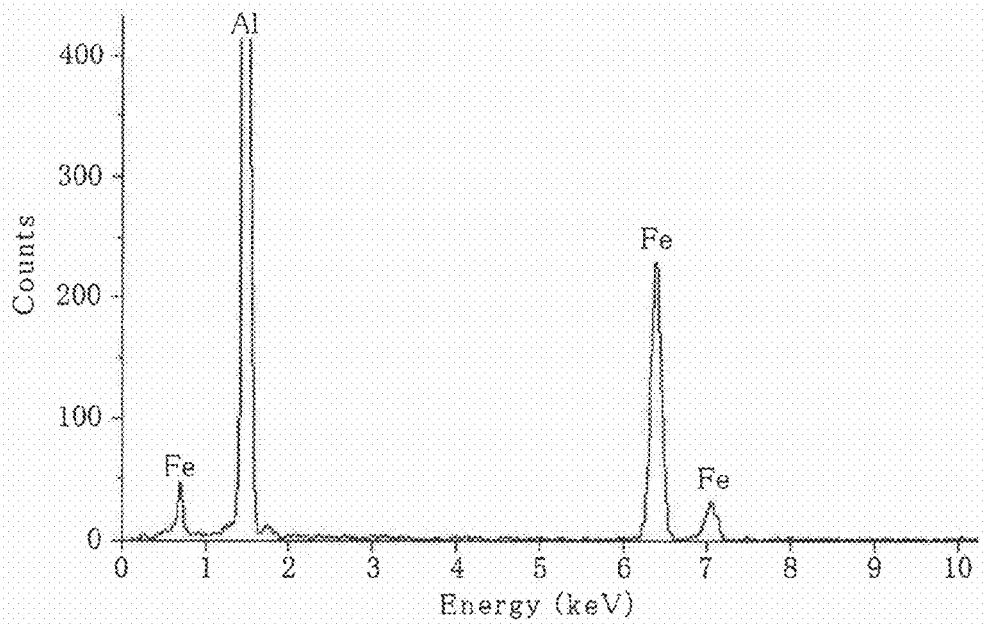
FIG. 15 is an explanatory diagram showing an analysis result of EDX at point *2 in FIG. 13.
Figure 16:
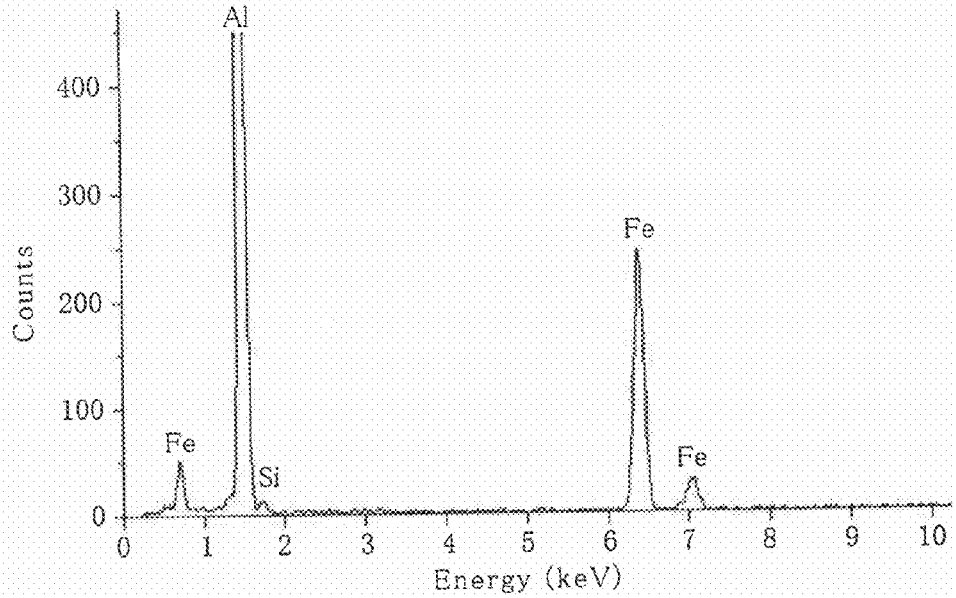
FIG. 16 is an explanatory diagram showing an analysis result of EDX at point *3 in FIG. 13.
Figure 17:
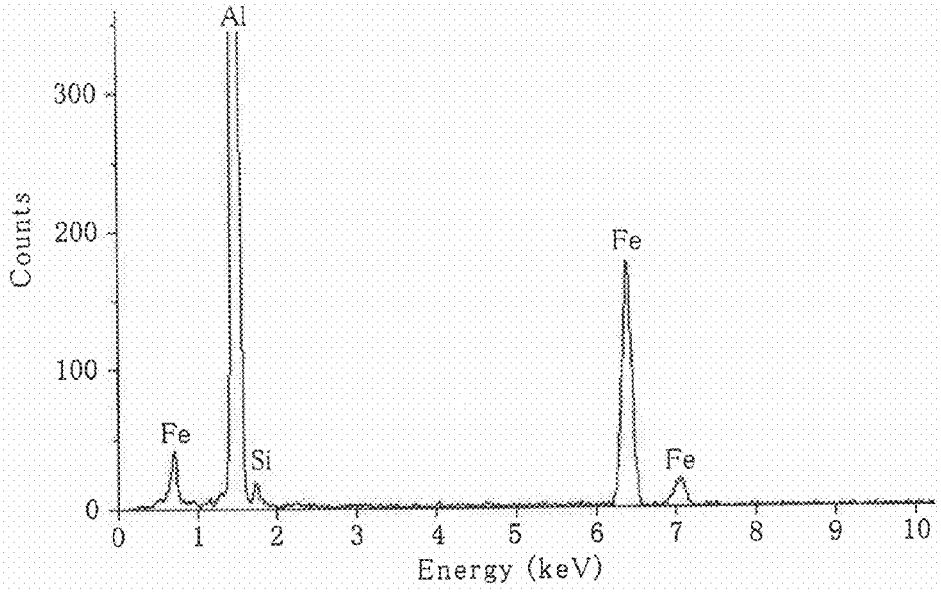
FIG. 17 is an explanatory diagram showing an analysis result of EDX at point *4 in FIG. 13.

Results (photograph) of observation by a transmission electron microscope (TEM) of the casted aluminum alloy (Example 11) before hot rolling is shown in FIG. 13. HF-2000 of Hitachi, Ltd. was used as the transmission electron microscope, and the observation was conducted under the conditions of an accelerating voltage of 200 kV and a beam diameter of ϕ1 nm. As shown in FIG. 13, a metal structure of the casted aluminum alloy 1 of Examples 11 has an α phase 2 formed of an Al matrix and a layered phase 4 formed in such a manner as to surround the α phase 2. Subsequently, for arbitrary place in the layered phase 4 (points *1 to *4 in FIG. 13), component elements present in the layered phase 4 were investigated by conducting energy dispersive X ray analysis (EDX). In the EDX analysis, NORAN VOYAGER III M3100 was used as an energy dispersive X ray analysis device, and Si/Li semiconductor detector was used as a detector. Measurement was conducted under the conditions of an energy resolution of 137 eV and a loading time of 30 seconds. Results are shown in FIGS. 14 to 17.

Shown in FIG. 14 to FIG. 17 are the results of the EDX analysis at points *1 to *4 in FIG. 13.

In the same manner, the aluminum alloy material (Example 11) after the hot rolling was observed by using the transmission electron microscope (TEM), and the EDX analysis at arbitrary four points of *1 to *4 was conducted. TEM photographs are shown in FIG. 18, and the results of EDX analysis at points *1 to *4 are shown in FIG. 19 to FIG. 22.

Figure 18:
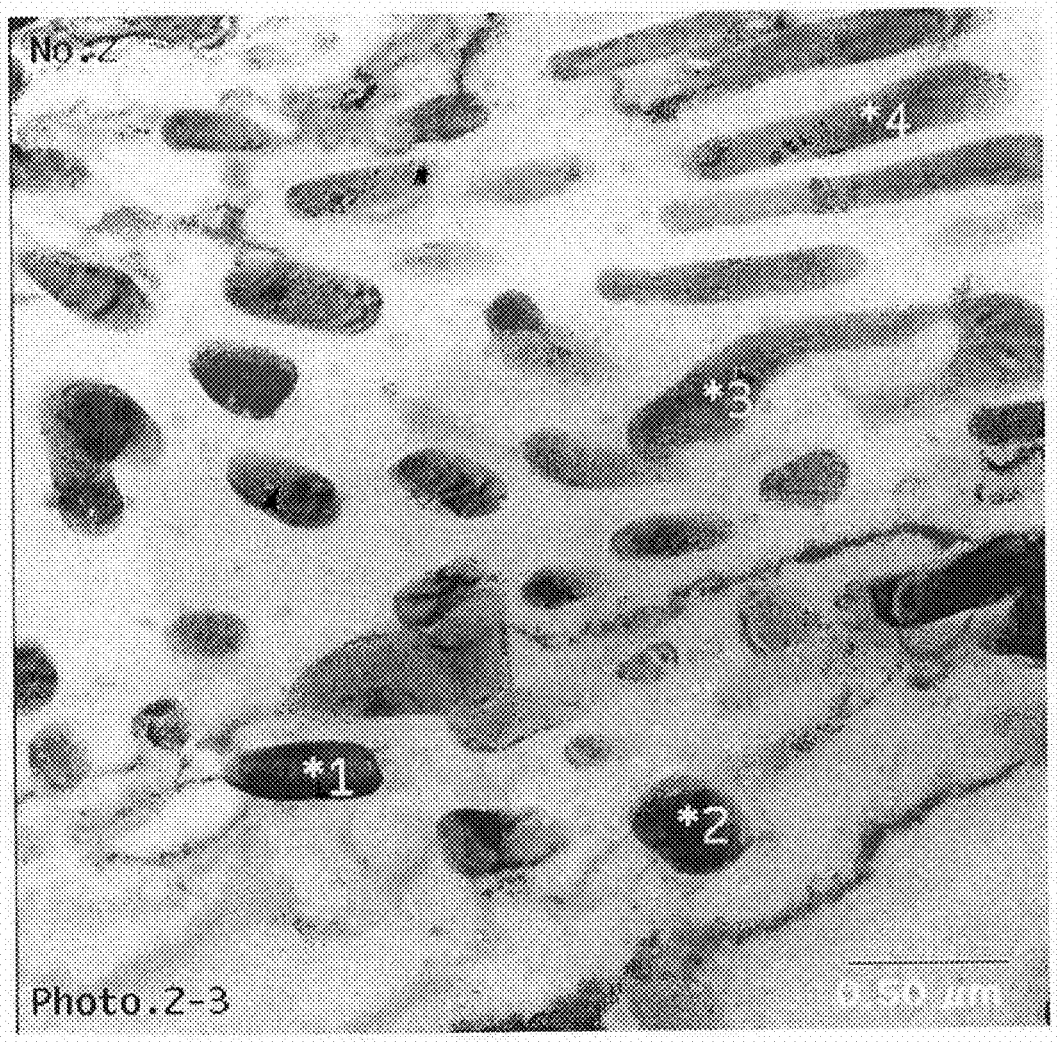
FIG. 18 is an explanatory view showing a TEM photograph of the alloy structure of the casted aluminum alloy (Example 11) after hot rolling in Embodiment 1.
Figure 19:
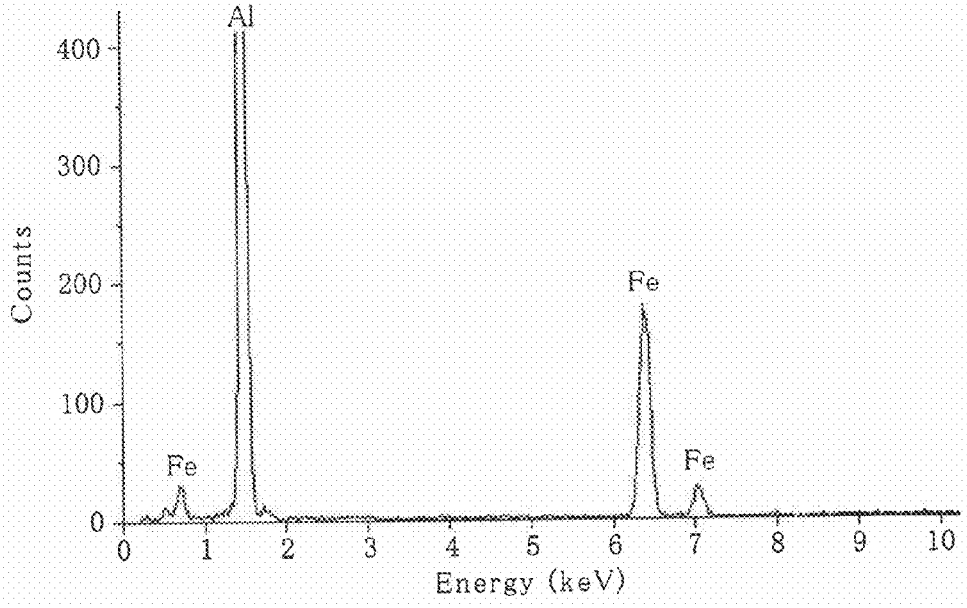
FIG. 19 is an explanatory diagram showing an analysis result of EDX at point *1 in FIG. 18.
Figure 20:
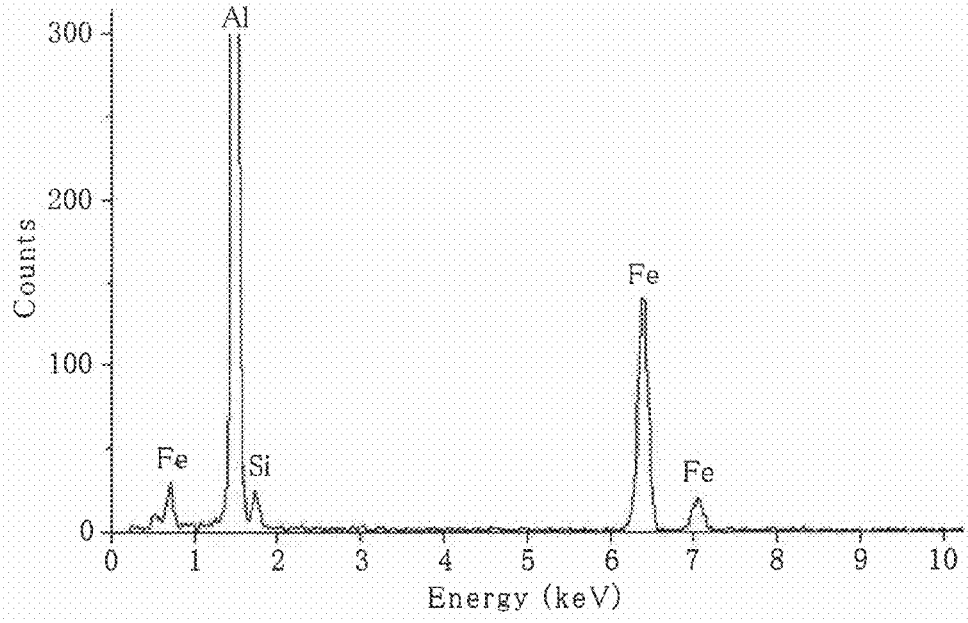
FIG. 20 is an explanatory diagram showing an analysis result of EDX at point *2 in FIG. 18.
Figure 21:
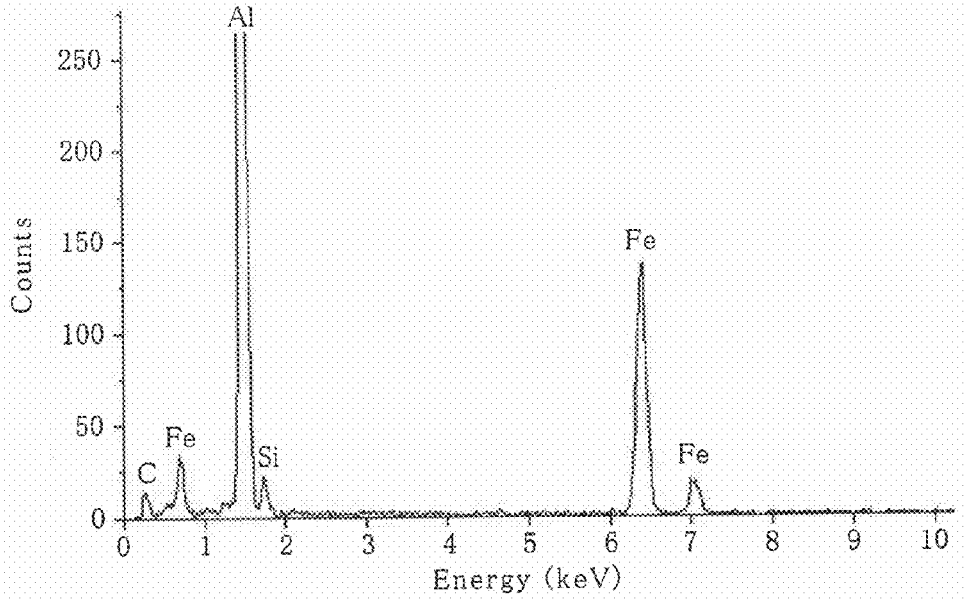
FIG. 21 is an explanatory diagram showing an analysis result of EDX at point *3 in FIG. 18.
Figure 22:
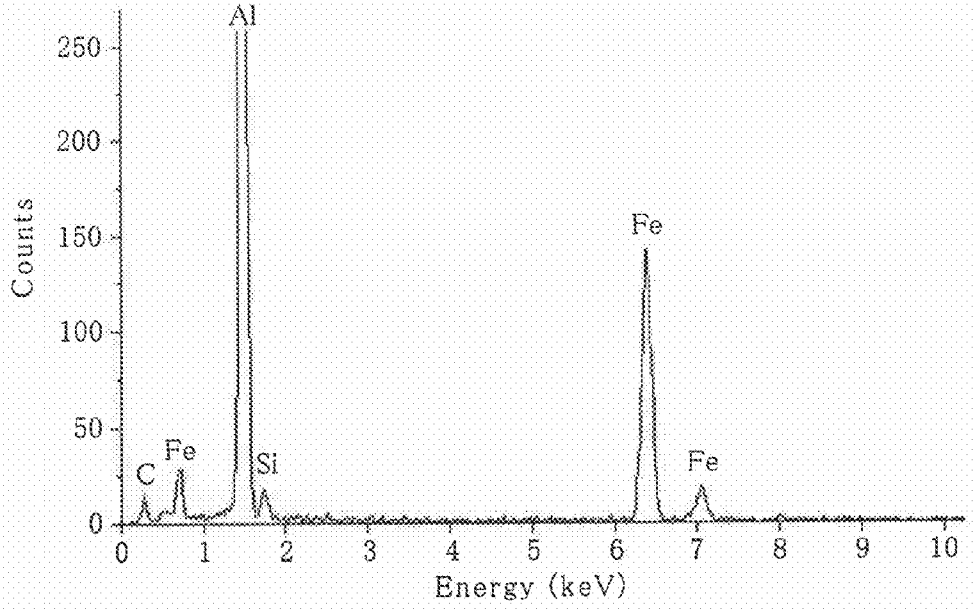
FIG. 22 is an explanatory diagram showing an analysis result of EDX at point *4 in FIG. 18.

As is understood from FIG. 13 to FIG. 17 and FIG. 18 to FIG. 22, only Al and Fe were detected in the layered phase 4 irrespectively of whether it was before and after the hot rolling, and the second component element Ti and the third component Zr were not present (see FIG. 13 and FIG. 18). Therefore, it is understood that the second component element Ti and the third component element Zr are present in Al matrix of the α phase 2.

Subsequently, in the present embodiment, strength, processability, formability, and corrosion resistance of Example 1 to Example 48 and Comparative Examples 1 to 37 were evaluated. Evaluation methods are as follows.

<Strength>

A tensile test piece was cut out from each of the aluminum alloy materials, and a tensile test defined in JIS Z2241 was performed to obtain tensile strength. Results are shown in Table 5 to Table 8.

Figure 6:
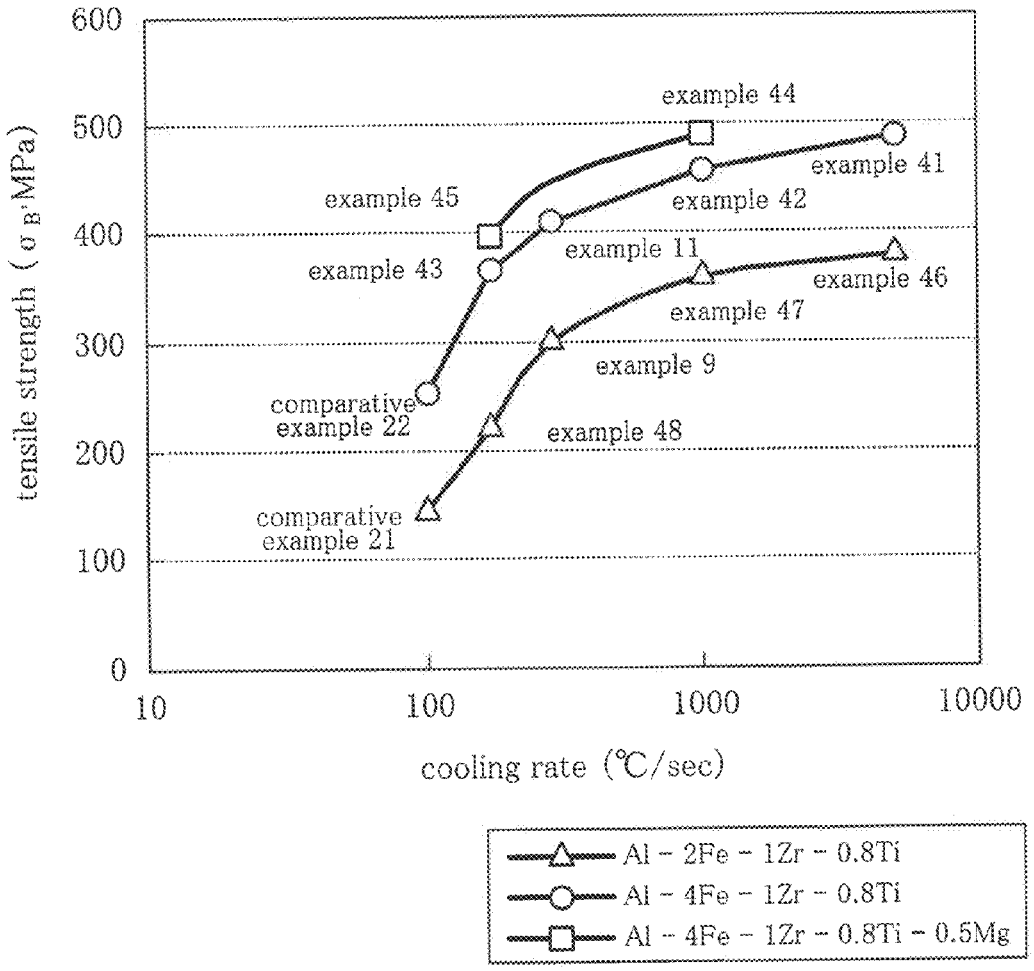
FIG. 6 is an explanatory graph showing a relationship between a cooling rate and tensile strength of each of aluminum alloy compositions in Embodiment 1.

Also, a relationship between the tensile strength measured by the tensile test and the cooling rate is shown in FIG. 6. Shown in FIG. 6 is a semi-logarithmic graph wherein a horizontal axis is the cooling rate (° C./sec.), and a vertical axis is the tensile strength (MPa). In FIG. 6, a relationship between the cooling rate and the tensile strength of each of three types aluminum alloy compositions, i.e. of the aluminum alloy materials of Al-2Fe-1Zr-0.8Ti (Comparative Example 21, Example 48, Example 9, Example 47, Example 46), Al-4Fe-1Zr-0.8Ti (Comparative Example 22, Example 43, Example 11, Example 42, Example 41), and Al-4Fe-1Zr-0.8Ti-0.5Mg (Example 45, Example 44).

<Processability>

Determination of processability was conducted by observation of presence/absence of generation of rolling crack after the rolling (hot rolling or cold rolling).

In other words, a surface of each of the aluminum alloy materials after rolling was observed, and the case wherein a rolling crack was observed on the surface was evaluated as no good (x), while the case wherein any rolling crack was not observed was evaluated as good (○). The continuously cast material in which only a cracked edge (crack generated on both ends of continuously cast material) was generated was evaluated as good (○) since it is possible to eliminate the cracked edge by a slitter in an actual process. Processability of the aluminum alloy material (Example 38) on which rolling was not performed was not evaluated.

<Formability>

Formability was observed by conducting a Hemming processing limit evaluation test for automobile aluminum alloy plate defined in JIS H7701, and generation of a crack on a surface at a bent part was observed by a stereoscopic microscope. The case wherein a crack was observed on the surface was evaluated as no good (x), and the case wherein any crack was not observed was evaluated as good (○). Results are shown in Table 5 to Table 8.

<Corrosiveness>

Corrosiveness was evaluated by conducting a corrosiveness test on a 6061 alloy and performing comparison with the result.

In other words, a test piece having a certain dimension was cut out from a commercially available 6016 alloy (Al-1.1Mg-0.8Si-0.1Cu-0.1Cr-0.03Ti), and a weight W1 of the test piece was measured. Subsequently, by using a NaCl aqueous solution having a concentration of 5 wt %, a saline water spraying test was conducted on the test piece (JIS Z2371). Subsequently, after removing a corrosive product generated on a surface of the test piece, a weight (W2) of the test piece was measured. A weight change ratio ΔWa (%) of the 6061 alloy test piece was calculated based on an expression of $\Delta Wa=|W2-W1|\times 100/W1$.

A test piece having a certain dimension was prepared from each of the casted aluminum alloys of Examples 1 to 48 and Comparative Example 1 to 37, and a saline water spraying test was conducted in the same manner as in the 6061 alloy. A weight W3 before the test and a weight W4 after the test were measured, and a weight change ratio ΔWb (%) of each of the test pieces was calculated based on an expression of $\Delta Wb=|W4-W3|\times 100/W3$.

In judgment of corrosiveness, the case of $\Delta Wb<0.8\Delta Wa$ was evaluated as excellent (◎), the case of $0.8Wa\leqq Wb\leqq 1.2Wa$ was evaluated as good (○), and the case of ΔWb>1.2ΔWa was evaluated as no good (x). The results are shown in Table 5 to Table 8.

As is understood from Table 5, Table 6 and FIG. 6, Example 1 to Example 48 exhibited satisfactory strength that was the tensile strength of 230 MPa or more and are casted aluminum alloys excellent in softening resistance, formability, and corrosion resistance.

As is apparent from the results of Example 1 to Example 48 (Table 5 and Table 6), by adding the second component element Ti and the third component element (Zr, Nb, Hf, Sc, Y) to Al—Fe alloy which is the base, the Al alloy having the high strength is obtained without impairment of formability and corrosion resistance. Also, when so required, it is possible to further improve the properties by adding the fourth component element Mg, the fifth component element (Cu, Cr, Co), and the sixth component element (V, Mo).

Also, it was found that the Example 1 to Example 48 are excellent in softening resistance, and higher strength thereof is achieved by applying thereto heat energy or strain energy in the subsequent steps. Also, reductions in properties depending on use condition (e.g. exposure to 300° C. for long time) are considerably small. Therefore, the alloys of the present invention are suitably used for automobile parts, for example.

In contrast, as is understood from Table 7 and Table 8, in the case of using the aluminum alloy that are out of the alloy composition range defined in the present invention (Comparative Example 1 to Comparative Example 20 and Comparative Example 28 to Comparative Example 37) and in the case where the cooling rate is insufficient (Comparative Examples 21 to 27), properties of the alloy cast materials are deteriorated.

TABLE 1

| | | essential component element (mass %) | | | | | | | selective component element (mass %) | | | | | | inevitable element (mass %) | | | | | | |
|---|---|---|---|---|---|---|---|---|---|---|---|---|---|---|---|---|---|---|---|---|---|
| | | first | second | third | | | | | fourth | fifth | | | sixth | | | | | | specific gravity | cooling rate of casting (° C./sec) | post-treatment |
| code | Al | Fe | Ti | Zr | Nb | Hf | Sc | Y | Mg | Cu | Cr | Co | V | Mo | Si | Mn | Ni | Be | (g/cm$^3$) | | |
| Example 1 | Bal. | 0.8 | 0.15 | 0.2 | — | — | — | — | — | — | — | — | — | — | <0.5 | <0.02 | <0.05 | — | 2.72 | 280 | hot rolling |
| Example 2 | | | | — | 0.2 | — | — | — | — | — | — | — | — | — | | | | — | 2.72 | | hot rolling |
| Example 3 | | | | — | — | 0.2 | — | — | — | — | — | — | — | — | | | | — | 2.72 | | hot rolling |
| Example 4 | | | | — | — | — | 0.2 | — | — | — | — | — | — | — | | | | — | 2.71 | | hot rolling |
| Example 5 | | | | — | — | — | — | 0.2 | — | — | — | — | — | — | | | | — | 2.72 | | hot rolling |
| Example 6 | | 2 | 0.2 | 0.5 | — | — | — | — | — | — | — | — | — | — | | | | — | 2.74 | | hot rolling |
| Example 7 | | | | — | 0.5 | — | — | — | — | — | — | — | — | — | | | | — | 2.75 | | hot rolling |
| Example 8 | | | | — | — | 0.5 | — | — | — | — | — | — | — | — | | | | — | 2.75 | | hot rolling |
| Example 9 | | | 0.8 | 1 | — | — | — | — | — | — | — | — | — | — | | | | — | 2.76 | | hot rolling |
| Example 10 | | 4 | 0.2 | 0.5 | — | — | — | — | — | — | — | — | — | — | | | | — | 2.78 | | hot rolling |
| Example 11 | | | 0.8 | 1 | — | — | — | — | — | — | — | — | — | — | | | | — | 2.80 | | hot rolling |
| Example 12 | | | 1 | 2 | — | — | — | — | — | — | — | — | — | — | | | | — | 2.82 | | hot rolling |
| Example 13 | | 5 | 0.8 | 1 | — | — | — | — | — | — | — | — | — | — | | | | — | 2.83 | | hot rolling |
| Example 14 | | 2 | 0.3 | 0.8 | — | — | — | — | 0.5 | — | — | — | — | — | | | | <0.01 | 2.76 | | hot rolling |
| Example 15 | | | | | — | — | — | — | 1 | — | — | — | — | — | | | | | 2.74 | | hot rolling |
| Example 16 | | | | | — | — | — | — | 2 | — | — | — | — | — | | | | | 2.72 | | hot rolling |
| Example 17 | | | 0.8 | 1 | — | — | — | — | 1 | — | — | — | — | — | | | | | 2.74 | | hot rolling |
| Example 18 | | 4 | 0.3 | 0.8 | — | — | — | — | | — | — | — | — | — | | | | | 2.77 | | hot rolling |
| Example 19 | | 2 | | | — | — | — | — | — | 0.2 | — | — | — | — | | | | — | 2.75 | | hot rolling |
| Example 20 | | | | | — | — | — | — | — | 0.5 | — | — | — | — | | | | — | 2.76 | | hot rolling |
| Example 21 | | 4 | | 0.8 | — | — | — | — | — | 1 | | — | — | — | | | | — | 2.77 | | hot rolling |
| Example 22 | | 2 | 0.8 | 1 | — | — | — | — | — | — | 1 | — | — | — | | | | — | 2.77 | | hot rolling |
| Example 23 | | | | | — | — | — | — | — | — | — | 1 | — | — | | | | — | 2.77 | | hot rolling |

TABLE 2

| | | essential component element (mass %) | | | | | | | selective component element (mass %) | | | | | |
|---|---|---|---|---|---|---|---|---|---|---|---|---|---|---|
| | | first | second | third | | | | | fourth | fifth | | | sixth | |
| code | Al | Fe | Ti | Zr | Nb | Hf | Sc | Y | Mg | Cu | Cr | Co | V | Mo |
| Example 24 | Bal. | 0.8 | 0.1 | 0.2 | — | — | — | — | — | — | — | — | 0.1 | — |
| Example 25 | | 2 | 0.3 | 0.5 | — | — | — | — | — | — | — | — | 0.45 | — |
| Example 26 | | | | | — | — | — | — | — | — | — | — | 0.2 | 0.2 |
| Example 27 | | | | 0.8 | — | — | — | — | — | — | — | — | — | 0.2 |
| Example 28 | | | | | — | — | — | — | — | — | — | — | — | 0.45 |
| Example 29 | | | 0.8 | 1 | — | — | — | — | — | — | — | — | 0.2 | — |
| Example 30 | | 4 | | | — | — | — | — | — | — | — | — | | — |
| Example 31 | | 2 | 0.2 | 0.5 | — | — | — | — | 2 | 0.2 | — | — | — | — |
| Example 32 | | | | | 0.2 | — | — | — | | — | — | — | — | — |
| Example 33 | | | | | — | — | — | — | | — | — | — | 0.2 | — |
| Example 34 | | | | | — | — | — | — | — | 1 | 0.3 | — | 0.1 | — |
| Example 35 | | | 0.3 | | — | — | — | — | 1 | — | 0.1 | — | — | — |
| Example 36 | | 3 | 0.2 | 0.6 | — | — | — | — | 2 | — | | 0.8 | — | — |
| Example 37 | | 2 | 0.8 | 1 | — | — | — | — | — | — | — | — | — | — |
| Example 38 | | | | | — | — | — | — | — | — | — | — | — | — |
| Example 39 | | 4 | | | — | — | — | — | — | — | — | — | — | — |
| Example 40 | | 2 | 0.2 | 0.5 | — | — | — | — | 2 | — | — | — | — | — |
| Example 41 | | 4 | 0.8 | 1 | — | — | — | — | — | — | — | — | — | — |
| Example 42 | | | | | — | — | — | — | — | — | — | — | — | — |
| Example 43 | | | | | — | — | — | — | — | — | — | — | — | — |
| Example 44 | | | | | — | — | — | — | 0.5 | — | — | — | — | — |
| Example 45 | | | | | — | — | — | — | | — | — | — | — | — |
| Example 46 | | 2 | | | — | — | — | — | — | — | — | — | — | — |
| Example 47 | | | | | — | — | — | — | — | — | — | — | — | — |
| Example 48 | | | | | — | — | — | — | — | — | — | — | — | — |

| | inevitable element (mass %) | | | | specific gravity | cooling rate of casting | post- |
|---|---|---|---|---|---|---|---|
| code | Si | Mn | Ni | Be | (g/cm$^3$) | (° C./sec) | treatment |
| Example 24 | <0.5 | <0.02 | <0.05 | — | 2.72 | 280 | hot rolling |
| Example 25 | | | | — | 2.75 | | hot rolling |
| Example 26 | | | | — | 2.75 | | hot rolling |
| Example 27 | | | | — | 2.75 | | hot rolling |
| Example 28 | | | | — | 2.76 | | hot rolling |
| Example 29 | | | | — | 2.76 | | hot rolling |
| Example 30 | | | | — | 2.80 | | hot rolling |
| Example 31 | | | | <0.01 | 2.72 | | hot rolling |
| Example 32 | | | | | 2.72 | | hot rolling |
| Example 33 | | | | | 2.72 | | hot rolling |
| Example 34 | | | | — | 2.77 | | hot rolling |
| Example 35 | | | | — | 2.73 | | hot rolling |
| Example 36 | | | | <0.01 | 2.75 | | hot rolling |
| Example 37 | | | — | — | 2.76 | | cold rolling |
| Example 38 | | | — | — | 2.76 | | heat treatment |
| Example 39 | | <0.5 | — | — | 2.80 | | cold rolling |
| Example 40 | | <0.02 | <0.05 | — | 2.72 | | cold rolling |
| Example 41 | | | — | — | 2.80 | 5000 | hot rolling |
| Example 42 | | | — | — | | 1000 | hot rolling |
| Example 43 | | | — | — | | 170 | hot rolling |
| Example 44 | | | — | — | 2.79 | 1000 | hot rolling |
| Example 45 | | | — | — | | 170 | hot rolling |
| Example 46 | | | — | — | 2.76 | 5000 | hot rolling |
| Example 47 | | | — | — | | 1000 | hot rolling |
| Example 48 | | | — | — | | 170 | hot rolling |

TABLE 3

| | | essential component element (mass %) | | | | | | | selective component element (mass %) | | | | | |
|---|---|---|---|---|---|---|---|---|---|---|---|---|---|---|
| | | first | second | third | | | | | fourth | fifth | | | sixth | |
| code | Al | Fe | Ti | Zr | Nb | Hf | Sc | Y | Mg | Cu | Cr | Co | V | Mo |
| Comparative Example 1 | Bal. | 0.5 | — | — | — | — | — | — | — | — | — | — | — | — |
| Comparative Example 2 | | 2 | — | — | — | — | — | — | — | — | — | — | — | — |
| Comparative Example 3 | | 4 | — | — | — | — | — | — | — | — | — | — | — | — |

TABLE 3-continued

| | | | | | | | | | | | | | |
|---|---|---|---|---|---|---|---|---|---|---|---|---|---|
| Comparative Example 4 | | — | 1 | — | — | — | — | — | — | — | — | — | — |
| Camparative Example 5 | | 0.8 | — | — | — | — | — | — | — | — | — | — | — |
| Comparative Example 6 | 7 | | 1 | — | — | — | — | — | — | — | — | — | — |
| Comparative Example 7 | — | 0.3 | | — | — | — | — | — | — | — | — | — | — |
| Comparative Example 8 | — | 0.8 | 2 | — | — | — | — | — | — | — | — | — | — |
| Comparative Example 9 | 1 | | | — | — | — | — | — | — | — | — | — | — |
| Comparative Example 10 | | 0.3 | — | 2 | — | — | — | — | — | — | — | — | — |
| Comparative Example 11 | 0.5 | | — | — | 0.8 | — | — | — | — | — | — | — | — |
| Comparative Example 12 | | 0.15 | 1 | — | — | 0.2 | — | — | — | — | — | — | — |
| Comparative Example 13 | | 0.3 | — | — | — | — | 1 | — | — | — | — | — | — |
| Comparative Example 14 | 2 | 0.8 | 1 | — | — | — | — | 0.03 | — | — | — | — | — |
| Comparative Example 15 | | 0.3 | 0.5 | — | — | — | — | 3 | — | — | — | — | — |
| Comparative Example 16 | | | | — | — | — | — | — | 1.5 | — | — | — | — |
| Comparative Example 17 | | | | — | — | — | — | — | — | 1.5 | — | — | — |
| Comparative Example 18 | | | | — | — | — | — | — | — | — | 1.5 | — | — |
| Comparative Example 19 | | | 0.8 | — | — | — | — | — | — | — | — | 0.5 | — |
| Comparative Example 20 | | | | — | — | — | — | — | — | — | — | — | 0.5 |

| | | inevitable element (mass %) | | | | specific gravity | cooling rate of casting | post- |
|---|---|---|---|---|---|---|---|---|
| | code | Si | Mn | Ni | Be | (g/cm$^3$) | (° C./sec) | treatment |
| | Comparative Example 1 | <0.5 | <0.02 | — | — | 2.71 | 280 | hot rolling |
| | Comparative Example 2 | | | — | — | 2.73 | | hot rolling |
| | Comparative Example 3 | | | — | — | 2.77 | | hot rolling |
| | Comparative Example 4 | | | — | — | 2.79 | | hot rolling |
| | Camparative Example 5 | | | — | — | 2.78 | | hot rolling |
| | Comparative Example 6 | | | — | — | 2.86 | | hot rolling |
| | Comparative Example 7 | | | — | — | 2.72 | | hot rolling |
| | Comparative Example 8 | | | — | — | 2.74 | | hot rolling |
| | Comparative Example 9 | | | — | — | 2.76 | | hot rolling |
| | Comparative Example 10 | | | — | — | 2.76 | | hot rolling |
| | Comparative Example 11 | | | — | — | 2.73 | | hot rolling |
| | Comparative Example 12 | | | — | — | 2.73 | | hot rolling |
| | Comparative Example 13 | | | — | — | 2.74 | | hot rolling |
| | Comparative Example 14 | | | — | — | 2.76 | | hot rolling |
| | Comparative Example 15 | | | — | — | 2.70 | | hot rolling |
| | Comparative Example 16 | | | — | — | 2.78 | | hot rolling |
| | Comparative Example 17 | | | — | — | 2.77 | | hot rolling |
| | Comparative Example 18 | | | — | — | 2.78 | | hot rolling |
| | Comparative Example 19 | | | — | — | 2.76 | | hot rolling |
| | Comparative Example 20 | | | — | — | 2.76 | | hot rolling |

TABLE 4

| | | essential component element (mass %) | | | | | | | selective component element (mass %) | | | | | |
|---|---|---|---|---|---|---|---|---|---|---|---|---|---|---|
| | | first | second | third | | | | | fourth | fifth | | | sixth | |
| code | Al | Fe | Ti | Zr | Nb | Hf | Sc | Y | Mg | Cu | Cr | Co | V | Mo |
| Comparative Example 21 | Bal. | 2 | 0.8 | 1 | — | — | — | — | — | — | — | — | — | — |
| Comparative Example 22 | | 4 | | | — | — | — | — | — | — | — | — | — | — |
| Comparative Example 23 | | 2 | | | — | — | — | — | 1 | — | — | — | — | — |
| Comparative Example 24 | | | | | — | — | — | — | | — | — | — | — | — |
| Comparative Example 25 | | | | | — | — | — | — | — | 1 | — | — | — | — |
| Comparative Example 26 | | | | | — | — | — | — | — | — | 1 | — | — | — |
| Comparative Example 27 | | | | | — | — | — | — | — | — | — | 1 | — | — |
| Comparative Example 28 | | 0.5 | 0.1 | 0.3 | — | — | — | — | — | — | — | — | — | — |
| Comparative Example 29 | | 4 | 0.8 | 0.5 | — | — | — | — | — | — | — | — | — | — |
| Comparative Example 30 | | | | 0.3 | 0.2 | — | — | — | — | — | — | — | — | — |
| Comparative Example 31 | | | | 0.03 | — | — | — | — | — | — | — | — | — | — |
| Comparative Example 32 | | | | 2.5 | — | — | — | — | — | — | — | — | — | — |
| Comparative Example 33 | | | — | — | — | — | — | — | — | — | — | — | — | — |
| Comparative Example 34 | | | — | — | — | — | — | — | — | — | — | — | — | — |
| Comparative Example 35 | | | 0.8 | 2.5 | — | — | — | — | — | — | — | — | — | — |
| Comparative Example 36 | | | 1.5 | 1 | — | — | — | — | — | — | — | — | — | — |
| Comparative Example 37 | | 7 | 0.8 | 1 | — | — | — | — | — | — | — | — | — | — |

TABLE 4-continued

| code | inevitable element (mass %) Si | Mn | Ni | Be | specific gravity (g/cm³) | cooling rate of casting (° C./sec) | post-treatment |
|---|---|---|---|---|---|---|---|
| Comparative Example 21 | <0.5 | <0.02 | — | — | 2.76 | 100 | hot rolling |
| Comparative Example 22 | | | — | — | 2.80 | | hot rolling |
| Comparative Example 23 | | | — | — | 2.74 | | hot rolling |
| Comparative Example 24 | | | — | — | 2.74 | | cold rolling |
| Comparative Example 25 | | | — | — | 2.78 | | hot rolling |
| Comparative Example 26 | | | — | — | 2.78 | | hot rolling |
| Comparative Example 27 | | | — | — | 2.78 | | hot rolling |
| Comparative Example 28 | | | — | — | 2.72 | 280 | hot rolling |
| Comparative Example 29 | | | — | — | 2.79 | | hot rolling |
| Comparative Example 30 | | | — | — | 2.79 | | hot rolling |
| Comparative Example 31 | | | — | — | 2.78 | | hot rolling |
| Comparative Example 32 | | | — | — | 2.82 | | hot rolling |
| Comparative Example 33 | | | 1 | — | 2.79 | | hot rolling |
| Comparative Example 34 | | 1 | — | — | 2.78 | | hot rolling |
| Comparative Example 35 | | <0.02 | — | — | 2.82 | 2000 | hot rolling |
| Comparative Example 36 | | | — | — | 2.81 | | hot rolling |
| Comparative Example 37 | | | — | — | 2.86 | | hot rolling |

TABLE 5

| code | softening resistance | tensile strength (Mpa) | process-ability | form-ability | corrosiveness |
|---|---|---|---|---|---|
| Example 1 | ○ | 260 | ○ | ○ | ◎ |
| Example 2 | ○ | 265 | ○ | ○ | ◎ |
| Example 3 | ○ | 260 | ○ | ○ | ◎ |
| Example 4 | ○ | 255 | ○ | ○ | ◎ |
| Example 5 | ○ | 258 | ○ | ○ | ◎ |
| Example 6 | ◎ | 320 | ○ | ○ | ◎ |
| Example 7 | ◎ | 315 | ○ | ○ | ◎ |
| Example 8 | ◎ | 320 | ○ | ○ | ◎ |
| Example 9 | ◎ | 325 | ○ | ○ | ◎ |
| Example 10 | ◎ | 385 | ○ | ○ | ◎ |
| Example 11 | ◎ | 420 | ○ | ○ | ◎ |
| Example 12 | ◎ | 450 | ○ | ○ | ◎ |
| Example 13 | ◎ | 455 | ○ | ○ | ◎ |
| Example 14 | ◎ | 340 | ○ | ○ | ◎ |
| Example 15 | ◎ | 410 | ○ | ○ | ◎ |
| Example 16 | ◎ | 460 | ○ | ○ | ◎ |
| Example 17 | ○ | 345 | ○ | ○ | ○ |
| Example 18 | ◎ | 460 | ○ | ○ | ◎ |
| Example 19 | ○ | 360 | ○ | ○ | ◎ |
| Example 20 | ○ | 410 | ○ | ○ | ○ |
| Example 21 | ○ | 440 | ○ | ○ | ○ |
| Example 22 | ◎ | 385 | ○ | ○ | ◎ |
| Example 23 | ◎ | 380 | ○ | ○ | ◎ |

TABLE 6

| code | softening resistance | tensile strength (Mpa) | process-ability | formability | corrosive-ness |
|---|---|---|---|---|---|
| Example 24 | ○ | 260 | ○ | ○ | ◎ |
| Example 25 | ◎ | 320 | ○ | ○ | ◎ |
| Example 26 | ◎ | 320 | ○ | ○ | ◎ |
| Example 27 | ◎ | 320 | ○ | ○ | ◎ |
| Example 28 | ○ | 285 | ○ | ○ | ◎ |
| Example 29 | ◎ | 390 | ○ | ○ | ◎ |
| Example 30 | ◎ | 415 | ○ | ○ | ◎ |
| Example 31 | ◎ | 410 | ○ | ○ | ◎ |
| Example 32 | ◎ | 405 | ○ | ○ | ◎ |
| Example 33 | ◎ | 385 | ○ | ○ | ◎ |
| Example 34 | ◎ | 470 | ○ | ○ | ◎ |
| Example 35 | ◎ | 385 | ○ | ○ | ◎ |
| Example 36 | ○ | 410 | ○ | ○ | ○ |
| Example 37 | ◎ | 285 | ○ | ○ | ◎ |
| Example 38 | ◎ | 305 | — | ○ | ◎ |
| Example 39 | ◎ | 385 | ○ | ○ | ◎ |
| Example 40 | ○ | 355 | ○ | ○ | ○ |
| Example 41 | ◎ | 495 | ○ | ○ | ◎ |
| Example 42 | ◎ | 460 | ○ | ○ | ◎ |
| Example 43 | ◎ | 360 | ○ | ○ | ◎ |
| Example 44 | ◎ | 495 | ○ | ○ | ◎ |
| Example 45 | ◎ | 398 | ○ | ○ | ◎ |
| Example 46 | ◎ | 380 | ○ | ○ | ◎ |
| Example 47 | ◎ | 365 | ○ | ○ | ◎ |
| Example 48 | ◎ | 230 | ○ | ○ | ◎ |

TABLE 7

| code | softening resistance | tensile strength (Mpa) | processability | formability | corrosiveness |
|---|---|---|---|---|---|
| Comparative Example 1 | X | 220 | ○ | ○ | ◎ |
| Comparative Example 2 | X | 260 | ○ | ○ | ◎ |
| Comparative Example 3 | X | 270 | ○ | ○ | ◎ |
| Comparative Example 4 | X | 320 | ○ | ○ | ◎ |
| Comparative Example 5 | X | 295 | ○ | ○ | ◎ |
| Comparative Example 6 | ◎ | 445 | X | X | ◎ |
| Comparative Example 7 | X | 205 | ○ | ○ | ◎ |
| Comparative Example 8 | X | 255 | ○ | ○ | ◎ |
| Comparative Example 9 | X | 235 | ○ | ○ | ◎ |
| Comparative Example 10 | X | 235 | ○ | ○ | ◎ |
| Comparative Example 11 | X | 230 | ○ | ○ | ◎ |
| Comparative Example 12 | X | 210 | ○ | ○ | ◎ |
| Comparative Example 13 | X | 230 | ○ | ○ | ◎ |

TABLE 7-continued

| code | softening resistance | tensile strength (Mpa) | processability | formability | corrosiveness |
|---|---|---|---|---|---|
| Comparative Example 14 | ◎ | 325 | ○ | ○ | ○ |
| Comparative Example 15 | ◎ | 415 | ○ | X | ○ |
| Comparative Example 16 | ○ | 430 | ○ | X | X |
| Comparative Example 17 | ◎ | 385 | ○ | X | ○ |
| Comparative Example 18 | ○ | 385 | ○ | X | ○ |
| Comparative Example 19 | ◎ | 365 | ○ | X | ◎ |
| Comparative Example 20 | ◎ | 345 | ○ | X | ○ |

TABLE 8

| code | softening resistance | tensile strength (Mpa) | processability | formability | corrosiveness |
|---|---|---|---|---|---|
| Comparative Example 21 | X | 235 | ○ | ○ | ◎ |
| Comparative Example 22 | X | 275 | ○ | X | ◎ |
| Comparative Example 23 | X | 250 | ○ | ○ | ◎ |
| Comparative Example 24 | X | 245 | ○ | X | ○ |
| Comparative Example 25 | X | 250 | ○ | ○ | ◎ |
| Comparative Example 26 | X | 250 | ○ | ○ | ◎ |
| Comparative Example 27 | X | 250 | ○ | ○ | ◎ |
| Comparative Example 28 | X | 225 | ○ | ○ | ◎ |
| Comparative Example 29 | X | 305 | ○ | ○ | ◎ |
| Comparative Example 30 | X | 300 | ○ | ○ | ◎ |
| Comparative Example 31 | X | 295 | X | X | ◎ |
| Comparative Example 32 | ○ | 450 | X | X | ◎ |
| Comparative Example 33 | X | 375 | X | X | X |
| Comparative Example 34 | X | 350 | ○ | ○ | ○ |
| Comparative Example 35 | ○ | 475 | X | X | ◎ |
| Comparative Example 36 | X | 410 | ○ | ○ | ◎ |
| Comparative Example 37 | ◎ | 480 | X | X | ◎ |

Also, in the present embodiment, a relationship between the annealing (heating) temperature and the residual hardness was investigated for an aluminum alloy material on which cold rolling was performed after a casting step and a casted aluminum alloy on which rolling was not performed.

Figure 23:
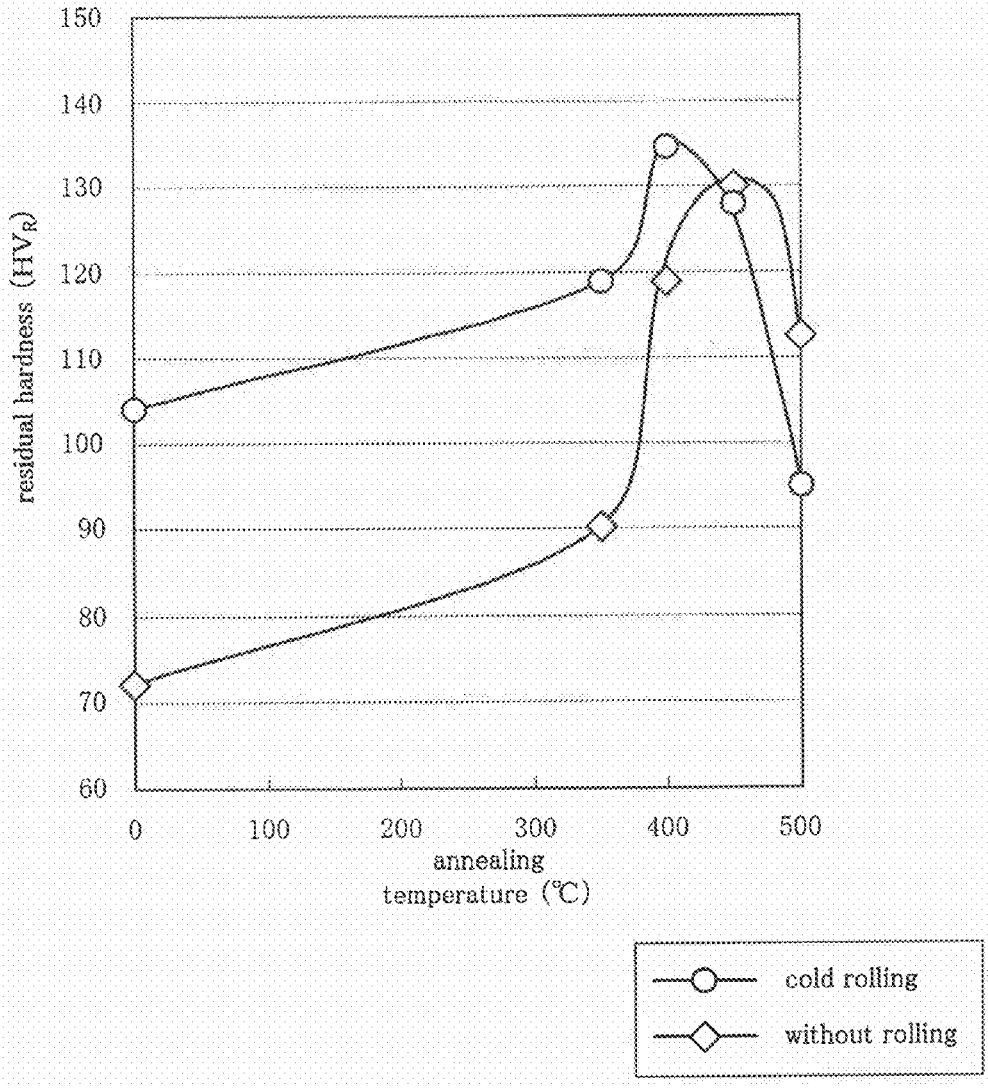
FIG. 23 is an explanatory graph showing a relationship between an annealing temperature and residual hardness in Embodiment 1.

More specifically, a casted aluminum alloy was prepared with a composition and under a condition similar to those of Example 11 (see Table 1). Cold rolling was performed on the casted aluminum alloy under a room temperature condition to reduce a thickness of the casted aluminum alloy by 50%. Heating (annealing) at a predetermined temperature was performed for one hour, and residual hardness of the aluminum alloy material after the heating was investigated. A relationship between the heating (annealing) temperature and the residual hardness was plotted on a graph. Results are shown in FIG. 23. Measurement of the residual hardness was conducted by using a Vickers hardness tester under the conditions of loading of 100 gf and a retention time of 20 seconds.

Also, a relationship between the heating (annealing) temperature and the residual hardness of the case of performing only annealing at each of the specified temperatures on a casted aluminum alloy produced with a composition and under a condition similar to those of Example 11 (see Table 1) was plotted on a graph. Results are shown in FIG. 23.

As is understood from FIG. 23, the residual hardness is improved by heating in both of the case where heating is performed after rolling and the case where heating is performed without rolling. Particularly, it is possible to more satisfactorily improve the residual hardness in the case of heating at 400° C. to 500° C., and it is possible to yet further improve the residual hardness in the case of heating at 400° C. to 450° C.

Embodiment 2

This embodiment is one example of producing a casted aluminum alloy by die casting.

Figure 24:
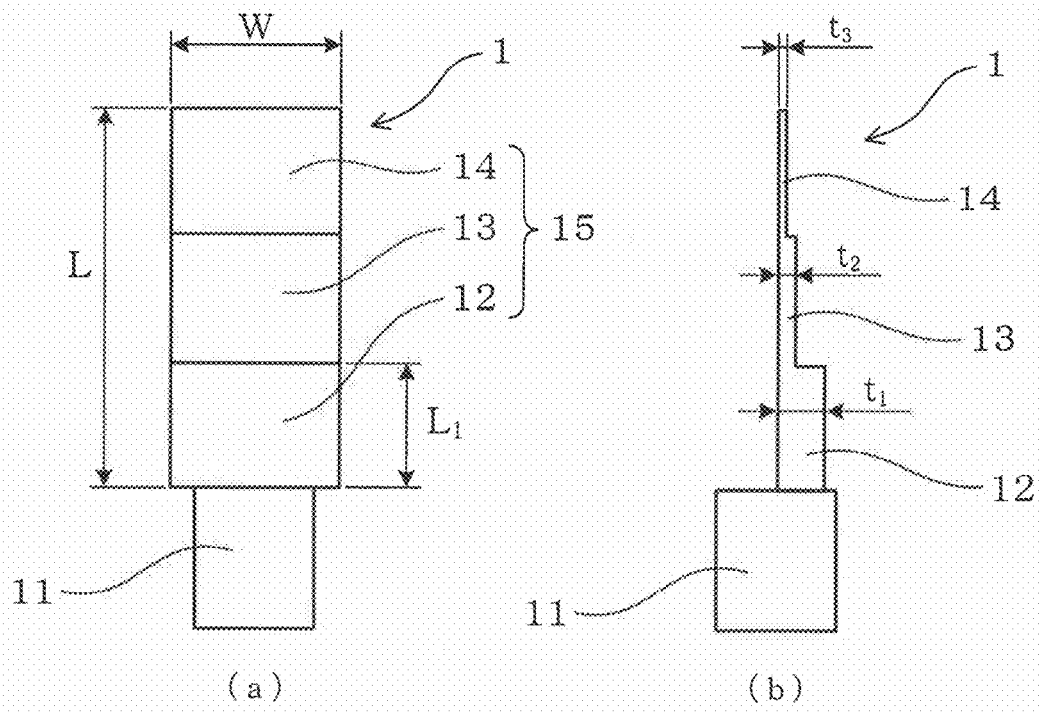
FIG. 24 is an explanatory diagram showing (a) a front view and (b) a side view of a casted aluminum alloy in Embodiment 2.

As shown in FIGS. 24(*a*) and (*b*), the casted aluminum alloy of the present embodiment has a base part 11 in the form of a cylindrical column and a plate-like part 15 integrally formed on the base part 11 and having a length L of 90 mm and a width W of 50 mm. The plate-like part 15 is formed of a large thickness plate part 12 (thickness $t_1$: 4 mm), a medium thickness plate part 13 (thickness $t_2$: 3 mm), and a thin plate part 14 (thickness $t_3$: 2 mm), which are different from one another in thickness. The large thickness plate part 12, the medium thickness plate part 13, and the thin plate part 14 are so formed as to be identical in size except for the thickness and have a length $L_1$ of 30 mm and a width W of 50 mm.

In the present embodiment, a casted aluminum alloy 1 having a shape shown in FIGS. 24(*a*) and (*b*) was produced by preparing a molten metal by melting an aluminum alloy having a specific composition at a temperature higher by 20° C. or more than a liquidus temperature thereof and casting the molten metal by die casting.

More specifically, an aluminum alloy containing 4 mass % of Fe, 0.85 mass % of Ti, and 1 mass % of Zr was prepared, and a molten metal was prepared by melting the alloy at a temperature (melting temperature) higher by 20° C. or more than a liquidus temperature of the alloy. Subsequently, the molten metal was injected and cast into a die having a desired shape. As shown in FIGS. 24(*a*) and (*b*), since the large thickness plate part 12, the medium thickness plate part 13, and the thin plate part 14 are different from one another in thickness, these parts are cooled at different cooling rates in the casting. In the present embodiment, cooling was performed in such a manner that the large thickness plate part 12, the medium thickness plate part 13, and the thin plate part 14 are cooled at cooling rates of 80° C./sec., 100° C./sec., and 400° C./sec. Thus, the casted aluminum alloy 1 was produced as shown in FIGS. 24 (*a*) and (*b*).

Figure 25:
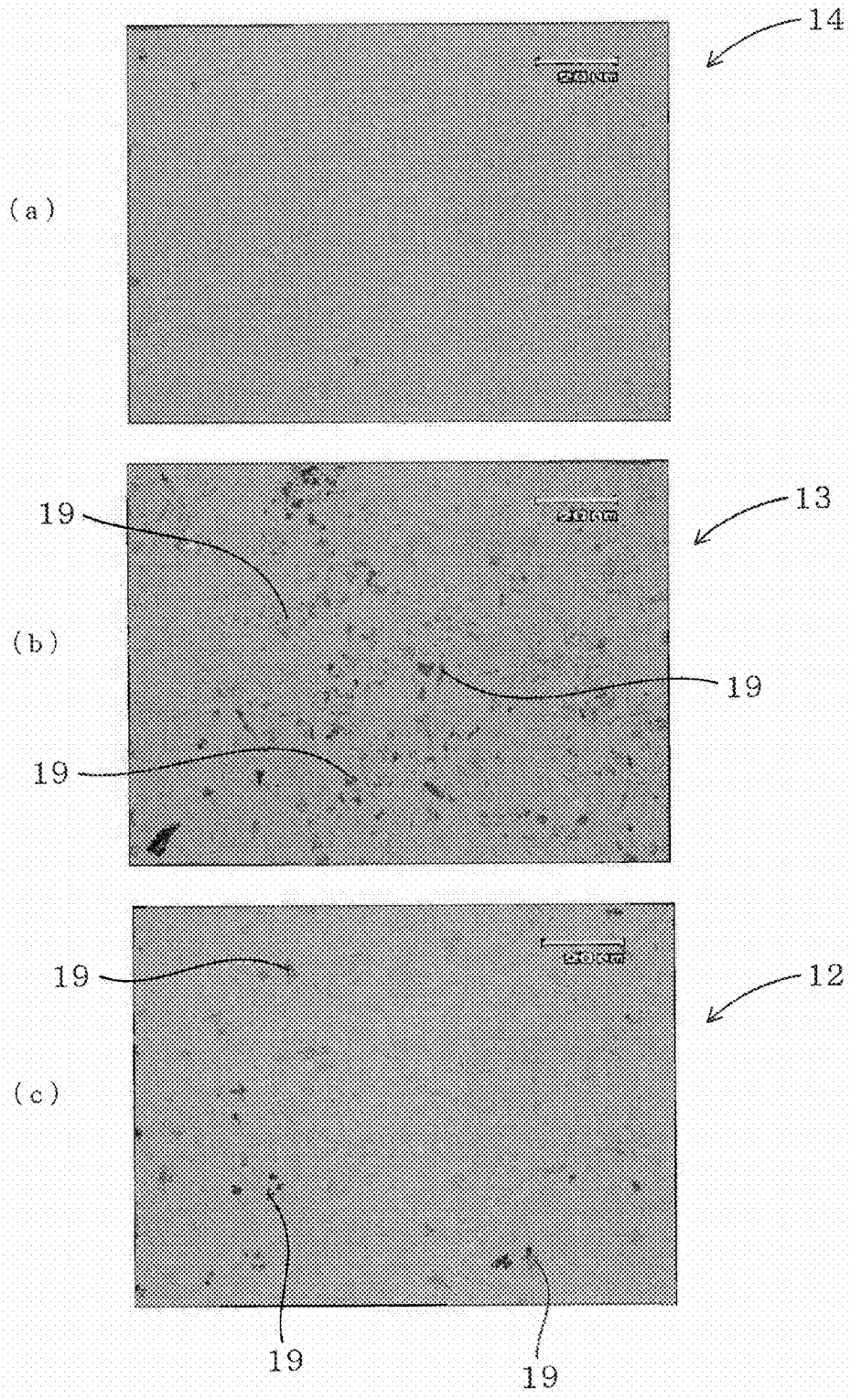
FIG. 25 is an explanatory view showing (a) an explanatory illustration of an alloy structure of a thin plate part of a casted aluminum alloy, (b) an explanatory illustration of an alloy structure of a medium thickness plate part of the casted aluminum alloy, and (c) an explanatory illustration of an alloy structure of a large thickness plate part of the casted aluminum alloy.

Subsequently, an alloy structure of the casted aluminum alloy produced in the present embodiment was observed by a metallographic microscope. Results of the observation are shown in FIGS. 25(*a*) to (*c*). Shown in FIG. 25(*a*) is the alloy structure of the thin plate part; FIG. 25(*b*) is the alloy structure of the medium thickness plate part; and FIG. 25(*c*) is the alloy structure of the large thickness plate part.

As shown in FIG. 25(*a*), in the thin plate part 14 cooled at the cooling rate of 400° C./sec., a bulk crystallizate is scarcely formed in the alloy structure. In contrast, in the medium thickness plate 13 that was cooled at the cooling rate of 100° C./sec. and the large thickness plate part 12 that was cooled at a cooling rate of 80° C./sec., a large amount of crystallizates 19 was generated in the alloy structures.

An area ratio of a crystallizate having a particle diameter of 5 μm or more in each of the thin plate part, the medium thickness plate part, and the large thickness plate part was measured. More specifically, the area ratio of the crystallizate in a observation visual field area (1 $mm^2$) was measured using an image analysis processing device by polishing each of the thin plate part, the medium thickness plate part, and the large thickness plate part to a mirror surface and measuring an area ratio of the obtained image by using an image analysis processing device while observing the mirror surface with a metallographic microscope having a magnification of ×1000. Results of the measurement are shown in Table 9 described later.

Residual hardness of each of the thin plate part, the medium thickness plate part, and the large thickness plate part was measured before and after annealing. Results are shown in Table 9. The annealing was performed under the conditions of 450° C. and one hour, and the residual hardness measurement was performed by using a Vickers hardness tester under the conditions of a loading of 100 gf and a retention time of 20 seconds.

TABLE 9

| part | plate thickness (mm) | colling rate (° C./sec) | area ratio of crystallizate (%) | residual hardness HVR of before annealing | residual hardness HVR of after annealing |
|---|---|---|---|---|---|
| thin plate part | 2 | 400 | 2.0 | 85 | 130 |
| medium thickness plate part | 3 | 100 | 5.2 | 68 | 74 |
| large thickness plate part | 4 | 80 | 8.5 | 65 | 65 |

As is understood from Table 9, the residual hardness in the thin plate part was largely increased after the annealing. In contrast, the residual hardness of each of the medium thickness plate part and the large thickness plate part was not increased much after the annealing and was scarcely changed. Therefore, it is understood that the casted aluminum alloy exhibits the particularly excellent softening resistance at the thin plate part.

In the casted aluminum alloy of the present embodiment, the thin plate part is the part which was cooled at the cooling rate of 150° C./sec. or more and less than 10000° C./sec. Therefore, it is considered that it is possible to achieve the effects of the present invention also in the case where the casting is performed by the die casting method by adjusting the cooling rate within the range of 150° C./sec. or more and less than 10000° C./sec.

The invention claimed is:

1. A casted aluminum alloy consisting essentially of:

0.8 to 5 mass % of Fe as a first component element, 0.15 to 1 mass % of Ti as a second component element, one or more kinds of third component elements selected from the group consisting of 0.05 to 2 mass % of Zr, 0.2 to 0.5 mass % of Nb, 0.2 to 0.5 mass % of Hf, 0.2 mass % of Sc, and 0.2 mass % of Y and in an amount that satisfies Fe>X>Ti when the content of the first component element Fe is Fe (mass %), the content of the second component element Ti is Ti (mass %), and a total content of the third component elements is X (mass %), optionally Mg, optionally at least one fifth component element selected from the group consisting of Cu, Cr and Co, optionally one or more of V and Mo, and a residual part comprising Al and inevitable impurities, wherein the casted aluminum alloy has a metal structure comprising an α phase that is formed of an Al matrix and a layered phase that is formed of an eutectic structure of the Al matrix and an Al—Fe compound in such a manner as to surround the α phase;

the Al matrix is formed of a supersaturated solid solution of Al in which the second component element and the third component element are dissolved; and an area ratio of a crystallizate formed of an intermetallic compound of Al, the second component element, and the third component element and having a particle diameter of 5 μm or more is less than 5% in an arbitrary section of the casted aluminum alloy, wherein the casted aluminum alloy has softening resistance of one of (i) HVR 1<HVR2<HVR 3 and (ii) HVR1<HVR2, HVR1<HVR3, and HVR2>HVR3 wherein HVR1 is hardness of the alloy before a post treatment, HVR2 is hardness of the alloy after the post treatment and HVR3 is hardness of the alloy after the post treatment and a subsequent heat treatment.

2. The casted aluminum alloy according to claim 1, comprising at least 0.2 to 1.2 mass % of Zr among the third component element group.

3. The casted aluminum alloy according to claim 1, comprising 0.05 to 2 mass % of Mg as a fourth component element.

4. The casted aluminum alloy according to claim 3, wherein Mg as the fourth component element is dissolved at least into the Al matrix.

5. The casted aluminum alloy according to claim 3, wherein Mg as the fourth component element forms an Al—Mg compound in the Al matrix.

6. The casted aluminum alloy according to claim 1, comprising 0.05 to 1 mass % of at least one fifth component element selected from a group consisting of Cu, Cr, and Co.

7. The casted aluminum alloy according to claim 6, wherein Cr and/or Co as the fifth component element is substituted with at least a part of the Al—Fe compound forming the layered phase to form an Al—(Fe, Cr) compound and/or an Al—(Fe, Co) compound.

8. The casted aluminum alloy according to claim 6, wherein Cu as the fifth component element forms an Al—Cu compound in the Al matrix.

9. The casted aluminum alloy according to claim 1, wherein the casted aluminum alloy comprises 0.05 to 2 mass % of Mg as a fourth component element and 0.05 to 1 mass % of Cu as a fifth component element, and that the fourth component element and the fifth component element form an Al—Cu—Mg compound in the Al matrix.

10. The casted aluminum alloy according to claim 1, comprising V and/or Mo as a sixth component element in an amount between 0.05 mass % and 0.5 mass %.

11. The casted aluminum alloy according to claim 10, wherein V and/or Mo as the sixth component element forms a compound with Al and a compound with Al, the second component element, and the third component element in the Al matrix.

12. An aluminum alloy material consisting essentially of 0. 8 to 5 mass % of Fe as a first component element, 0.15 to 1 mass % of Ti as a second component element, one or more kinds of third component elements selected from a group consisting of 0.05 to 2 mass % of Zr, 0.2 to 0.5 mass % of Nb, 0.2 to 0.5 mass % of Hf, 0.2 mass % of Sc, and 0.2 mass % of Y and in an amount that satisfies Fe>X>Ti when the content of the first component element Fe is Fe (mass %), the content of the second component element Ti is Ti (mass %), and a total content of the third component elements is X (mass %); and optionally Mg, optionally at least one fifth component element selected from the group consisting of Cu, Cr and Co, optionally one or more of V and Mo, and a residual part comprising Al and inevitable impurities, wherein the aluminum alloy material has a metal structure comprising an α phase that is formed of an Al matrix and a layered phase that is formed of an eutectic structure of the Al matrix and an Al—Fe compound in such a manner as to surround the α phase;

the Al matrix is formed of Al and/or a supersaturated solid solution of Al in which the second component element and the third component element are dissolved; and a precipitate formed of an intermetallic compound of Al, the second component element, and the third component element and having a particle diameter of 2 to 500 nm is dispersed in the Al matrix, wherein the casted aluminum alloy has softening resistance of one of (i) HVR1<HVR2<HVR3 and (ii) HVR1<HVR2, HVR1<HVR3, and HVR2>HVR3 wherein HVR1 is hardness of the alloy before a post treatment, HVR2 is hardness of the alloy after the post treatment and HVR3 is hardness of the alloy after the post treatment and a subsequent heat treatment.

13. The aluminum alloy material according to claim 12, comprising at least 0.2 to 1.2 mass % of Zr among the third component element group.

14. The aluminum alloy material according to claim 12, comprising 0.05 to 2 mass % of Mg as a fourth component element.

15. The aluminum alloy material according to claim 14, wherein Mg as the fourth component element is dissolved at least into the Al matrix.

16. The aluminum alloy material according to claim 14, wherein Mg as the fourth component element forms an Al—Mg compound in the Al matrix.

17. The aluminum alloy material according to claim 12, comprising 0.05 to 1 mass % of at least one fifth component element selected from a group consisting of Cu, Cr, and Co.

18. The aluminum alloy material according to claim 17, wherein Cr and/or Co as the fifth component element is substituted with at least a part of the Al—Fe compound forming the layered phase to form an Al—(Fe, Cr) compound and/or an Al—(Fe, Co) compound.

19. The aluminum alloy material according to claim 17, wherein Cu as the fifth component element forms an Al—Cu compound in the Al matrix.

20. The aluminum alloy material according to claim 12, wherein the aluminum alloy material comprises 0.05 to 2 mass % of Mg as a fourth component element and 0.05 to 1 mass % of Cu as a fifth component element, and that the fourth component element and the fifth component element form an Al—Cu—Mg compound in the Al matrix.

21. The aluminum alloy material according to claim 12, comprising V and/or Mo as a sixth component element in an amount between 0.05 mass % and 0.5 mass %.

22. The aluminum alloy material according to claim 21, wherein V and/or Mo as the sixth component element forms a compound with Al and a compound with Al, the second component element, and the third component element in the Al matrix.

23. The casted aluminum alloy according to claim 1, comprising at least 0.8 mass % or higher and less than 3 mass % of Fe.

* * * * *

UNITED STATES PATENT AND TRADEMARK OFFICE

CERTIFICATE OF CORRECTION

PATENT NO. : 8,303,736 B2
APPLICATION NO. : 12/524004
DATED : November 6, 2012
INVENTOR(S) : Hideaki Matsuoka It is certified that error appears in the above-identified patent and that said Letters Patent is hereby corrected as shown below:

Column 35, Line 32, delete "; and"

Signed and Sealed this
Nineteenth Day of March, 2013

Teresa Stanek Rea
*Acting Director of the United States Patent and Trademark Office*